US006911783B2

(12) United States Patent
Mima

(10) Patent No.: US 6,911,783 B2
(45) Date of Patent: Jun. 28, 2005

(54) DRIVE METHOD FOR PLASMA DISPLAY PANEL AND DRIVE DEVICE FOR PLASMA DISPLAY PANEL

(75) Inventor: Kunihiro Mima, Neyagawa (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 98 days.

(21) Appl. No.: 10/399,463

(22) PCT Filed: Oct. 24, 2001

(86) PCT No.: PCT/JP01/09316

§ 371 (c)(1),
(2), (4) Date: Nov. 17, 2003

(87) PCT Pub. No.: WO02/35509

PCT Pub. Date: May 2, 2002

(65) Prior Publication Data

US 2004/0075398 A1 Apr. 22, 2004

(30) Foreign Application Priority Data

Oct. 25, 2000 (JP) ..... 2000-325298

(51) Int. Cl.[7] ..... G09G 3/10; G09G 3/28
(52) U.S. Cl. ..... 315/169.4; 345/67; 345/60
(58) Field of Search ..... 315/169.4, 169.1; 345/67, 60, 66, 68, 204, 211, 55, 63

(56) References Cited

U.S. PATENT DOCUMENTS

| | | | | |
|---|---|---|---|---|
| 6,104,361 A | * | 8/2000 | Rutherford | 345/55 |
| 6,140,984 A | | 10/2000 | Kanazawa et al. | 345/67 |
| 6,288,495 B1 | | 9/2001 | Yashiro | 315/169.1 |
| 6,400,342 B2 | * | 6/2002 | Hirakawa | 345/60 |
| 6,525,701 B1 | * | 2/2003 | Kang | 345/60 |
| 6,529,177 B2 | * | 3/2003 | Nakamura | 345/60 |

FOREIGN PATENT DOCUMENTS

| | | |
|---|---|---|
| JP | 108096714 A | 4/1996 |
| JP | 9-311661 | 12/1997 |
| JP | 10282927 A | 10/1998 |
| JP | 2000231359 A | 8/2000 |
| JP | 2000-284743 | 10/2000 |

* cited by examiner

*Primary Examiner*—Don Wong
*Assistant Examiner*—Chuc Tran

(57) ABSTRACT

The object of the invention is to provide a driving method and a driving apparatus for PDPs (Plasma Display Panels) which make it possible to inhibit error address discharges that may occur in a PDP in which a plurality of pairs of display electrodes, each made up of a scan electrode and a sustain electrode, are disposed in stripes, and the sustain electrodes from different cells are positioned adjacent to each other due to the fact that, in some of the cells, the scan electrode and the sustain electrode are disposed in a different order than in other cells.

In order to achieve the object, it is arranged so that the sustain electrodes positioned adjacent to each other belong to different groups such as a-group and b-group, and when an address discharge is generated in a cell whose sustain electrode belong to the a-group, a predetermined voltage is applied to the a-group sustain electrodes, while a voltage being lower then the predetermined voltage is applied to the b-group sustain electrodes that are each positioned adjacent to the a-group sustain electrodes. Thus, it is possible to inhibit occurrence of improper address discharges because the potential difference between (a) the scan electrode of the cell having an address discharge and (b) the b-group sustain electrode of the adjacent cell is smaller than it is in the prior art.

8 Claims, 14 Drawing Sheets t=ti ti<t<ti+1 ti<t<ti+1 ti+1<t<ti+2

DRIVE METHOD FOR PLASMA DISPLAY PANEL AND DRIVE DEVICE FOR PLASMA DISPLAY PANEL

TECHNICAL FIELD

The present invention relates to plasma display panels used for image display in computers, televisions, and the like, particularly, a driving method and a driving apparatus for surface-discharge type plasma display panels in which the matrix display system is used.

BACKGROUND ART

In recent years, the matrix display system is one of the most commonly applied systems for surface-discharge type Plasma Display Panels (hereafter referred to as PDPs) used for image display in computers, televisions, and the like.

A surface-discharge type PDP, which is a typical example in which the matrix display system is used, comprises a front panel on which scan electrodes and sustain electrodes are disposed alternately and in parallel with each other, and a rear panel on which address electrodes are disposed in parallel, the rear panel being disposed in parallel with the front panel with a spacing member interposed therebetween in a manner that the address electrodes orthogonally intersect the scan electrodes and the sustain electrodes. A cell is formed at each of the intersections of the three electrodes. In a surface-discharge type PDP, firstly a wall charge is generated in the address discharge stage during which an address pulse is applied to a scan electrode and an address electrode of the cell that is to emit light, and secondly a surface discharge is generated by a sustain pulse being applied alternately to the scan electrode and the sustain electrode of the cell where the wall charge has been generated. According to this kind of method, it is possible to change the luminance of the PDP freely by adjusting the frequency of the sustain discharges generated between the scan electrodes and the sustain electrodes. There is, however, a possibility of an unnecessary surface discharge occurring in an adjacent cell during the sustain discharge period due to the structure where the scan electrodes and the sustain electrodes are disposed alternately, and each scan electrode is therefore positioned adjacent to a sustain electrode that belongs to an adjacent cell.

In order to solve such a problem, Japanese Laid-Open Patent Application Publication No. 8-212933 discloses a technique to arrange so that a cell and its adjacent cell have electrodes of a same kind being positioned adjacent to each other, by reversing, cell by cell, the order in which a scan electrode and a sustain electrode are disposed, instead of providing a scan electrode and a sustain electrode alternately. According to this technique, electrodes of two cells positioned adjacent to each other have the same electric potential even at times of sustain discharges; it is therefore possible to inhibit unnecessary surface discharges occurring between the two adjacent cells at times of sustain discharges.

The above-mentioned prior art however presents a possibility of having an error discharge at times of address discharges. More specifically, at times of address discharges, a wall charge is usually generated through a process where a discharge between a scan electrode and an address electrode induces another discharge between a scan electrode and a sustain electrode. According to the technique disclosed in the laid-open application, since a sustain electrode is positioned adjacent to another sustain electrode of an adjacent cell, an address discharge may spread over to the sustain electrode of the adjacent cell. Consequently, due to the discharge, there is a possibility that the amount of wall charge near the sustain electrode in the adjacent cell could be changed (called an error discharge), and that the address discharge in the adjacent cell cannot be generated properly. Especially, PDPs of fine display quality have more possibilities of having such improper address discharges in an adjacent cell since the distances between cells are short and the amount of wall charge in the adjacent cell may be easily changed.

In light of the problem stated above, an object of the present invention is to provide a driving method and a driving apparatus for PDPs by which it is possible to inhibit occurrence of improper address discharges in such PDPs in which one cell and its adjacent cell have their respective sustain electrodes positioned adjacent to each other.

DISCLOSURE OF THE INVENTION

In order to achieve the object, the present invention provides a driving method for a Plasma Display Panel that includes pairs of display electrodes made up of a first row electrode and a second row electrode disposed in stripes and column electrodes, the display electrodes being disposed so as to intersect the column electrodes with a discharge space interposed therebetween so that a cell is formed at each of intersections, and in at least one of the pairs of display electrodes, the first row electrode and the second row electrode are disposed in a reversed order compared to the other pairs of display electrodes, wherein a potential difference is made at a time of generating an address discharge, that is when a voltage is applied to a combination of the first row electrode and the column electrode, the potential difference being a difference between (a) a voltage applied to a particular second row electrode of a cell having the address discharge and (b) a voltage applied to another second row electrode that is positioned adjacent to the particular second row electrode and is of a cell positioned adjacent to the cell having the address discharge.

With this arrangement, it is possible to make the potential difference between the first row electrode and the second row electrode of the cell having an address discharge larger than the potential difference between another second row electrode positioned adjacent to that second row electrode and the same first row electrode. Thus, it is possible to inhibit an improper address discharge since the wall charge in the adjacent cell will not be changed by an error discharge occurring at times of address discharges.

Since at times of address discharges, a negative voltage is usually applied to the first row electrode, it is preferable that the driving method have an arrangement wherein the voltage applied to the second row electrode of the cell having the address discharge is higher than the voltage applied to the other second row electrode positioned adjacent to that second row electrode.

Here, the driving method may have an arrangement wherein in every part of the plasma display panel, any two cells whose second row electrodes are positioned adjacent to each other belong to two different cell groups, and the address discharges are generated sequentially within each of the two different cell groups.

With this arrangement, at times of address discharges, the voltages to be applied to the second row electrodes need to be changed less number of times; therefore, it is possible to reduce electricity consumption required for charges and discharges of the panel electrostatic capacitance loads at the second row electrodes, that is to say reduce ineffective electricity, which is electricity that does not contribute to generating the discharges.

The present invention provides a driving apparatus for a plasma display panel that includes pairs of display electrodes made up of a first row electrode and a second row electrode disposed in stripes and column electrodes, the display electrodes being disposed so as to intersect the column electrodes with a discharge space interposed therebetween so that a cell is formed at each of intersections, and in at least one of the pairs of display electrodes, the first row electrode and the second row electrode are disposed in a reversed order compared to the other pairs of display electrodes, the driving apparatus comprising: a first row electrode driving unit operable to apply a voltage to each of the first row electrodes; a second row electrode driving unit operable to apply a voltage to each of the second row electrodes; and a column electrode driving unit operable to apply a voltage to each of the column electrodes, wherein the first row electrode driving unit and the column electrode driving unit generate an address discharge in a selected cell by applying a voltage to a first row electrode and a column electrode of the selected cell respectively, the first row electrode driving unit and the second row electrode driving unit generate a sustain discharge in the selected cell by applying a voltage to the first row electrode and a second row electrode of the selected cell respectively after the address discharge being generated, the second row electrode driving unit includes (a) a first voltage subunit operable to apply a first voltage to each of the second row electrodes of cells belonging to a first cell group, and (b) a second voltage subunit operable to apply a second voltage, which has a potential difference from the first voltage, to each of the second row electrodes of cells belonging to a second cell group, each of the second row electrodes in the first cell group being positioned adjacent to each of the second row electrodes in the second cell group, and the driving apparatus further comprises a timing pulse generating unit operable to adjust drive timings of the first voltage subunit and the second voltage subunit.

With this arrangement, it is possible to have a potential difference between two second row electrodes; therefore, for example, it is possible to inhibit improper address discharges by arranging so that the potential difference between the first row electrode and the second row electrode of the cell having an address discharge is larger than the potential difference between another second row electrode positioned adjacent to that second row electrode and the same first row electrode.

Further, the driving apparatus may have an arrangement wherein all the cells in the plasma display panel belong to either the first cell group or the second cell group, and the timing pulse generating unit includes: a cell structure storing subunit operable to store therein information on locations of the second row electrodes belonging to the first cell group and the second row electrodes belonging to the second cell group; a detecting subunit operable to detect a location of a cell having an address discharge; and a cell structure identifying subunit operable to identify, by referring to the information stored in the cell structure storing subunit corresponding to the location of the cell detected by the detecting subunit, to which of the first and the second cell groups the second row electrode of the cell having the address discharge belongs and adjust the drive timings.

With this arrangement, even if there are some areas where a first row electrode and a second row electrode are disposed in a different order than in other areas, it is possible to maintain the potential difference between the two second row electrodes depending on the order in which the row electrodes are disposed in each area.

Moreover, the driving apparatus may have an arrangement wherein all the cells in the plasma display panel belong to either the first cell group or the second cell group, and the first row electrode driving unit applies the voltages so that the address discharges are generated sequentially within each of the first and the second cell groups.

With such an arrangement of a PDP driving apparatus, at times of address discharges, the voltages to be applied to the second row electrodes need to be changed less number of times; therefore, it is possible to reduce electricity consumption required for charges and discharges of the panel electrostatic capacitance loads at the second row electrodes, that is to say reduce ineffective electricity, which is electricity that does not contribute to generating the discharges.

More specifically, the driving apparatus may have an arrangement wherein the first row electrode driving unit includes: a first voltage subunit operable to apply a scan pulse to each of the first row electrodes belonging to the first cell group; and a second voltage subunit operable to apply a scan pulse to each of the first row electrodes belonging to the second cell group.

With this arrangement, it is possible to generate the address discharges in each cell group sequentially.

Furthermore, it is also acceptable that the driving method has an arrangement wherein a phase of the first voltage applied by the first voltage subunit and a phase of the second voltage applied by the second voltage subunit are staggered from each other by half a cycle.

BEST MODE FOR CARRYING OUT THE INVENTION

The following describes embodiments of the present invention, with reference to the attached drawings. The embodiments and the drawings used in the present application are designed for showing examples, and the present invention is not limited to these.

First Embodiment

Structure of the PDP 100

Figure 1:
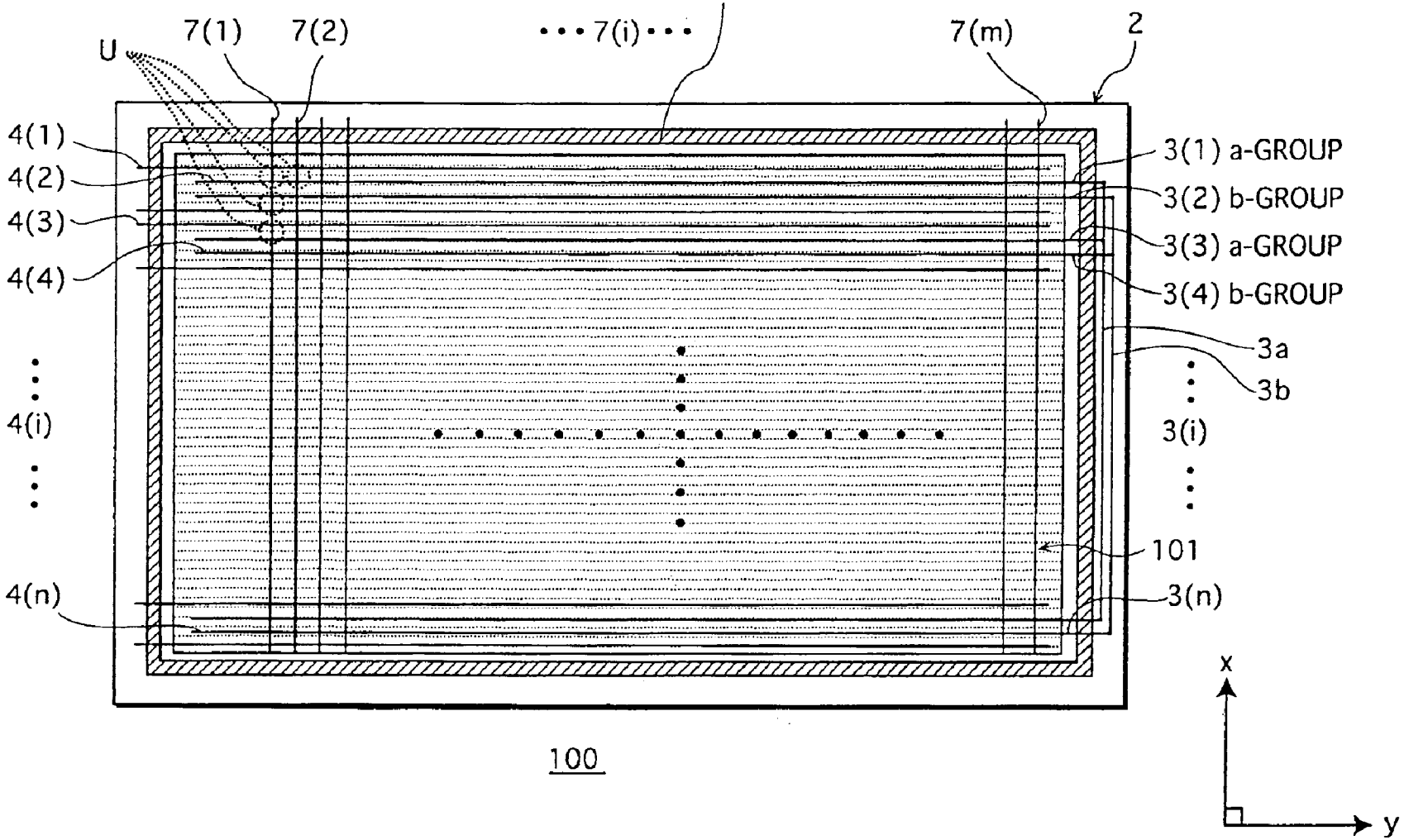
FIG. 1 is a schematic plan view of a PDP from which a front glass substrate is removed and to which the driving method and the driving apparatus of the first embodiment are applied.
Figure 2:
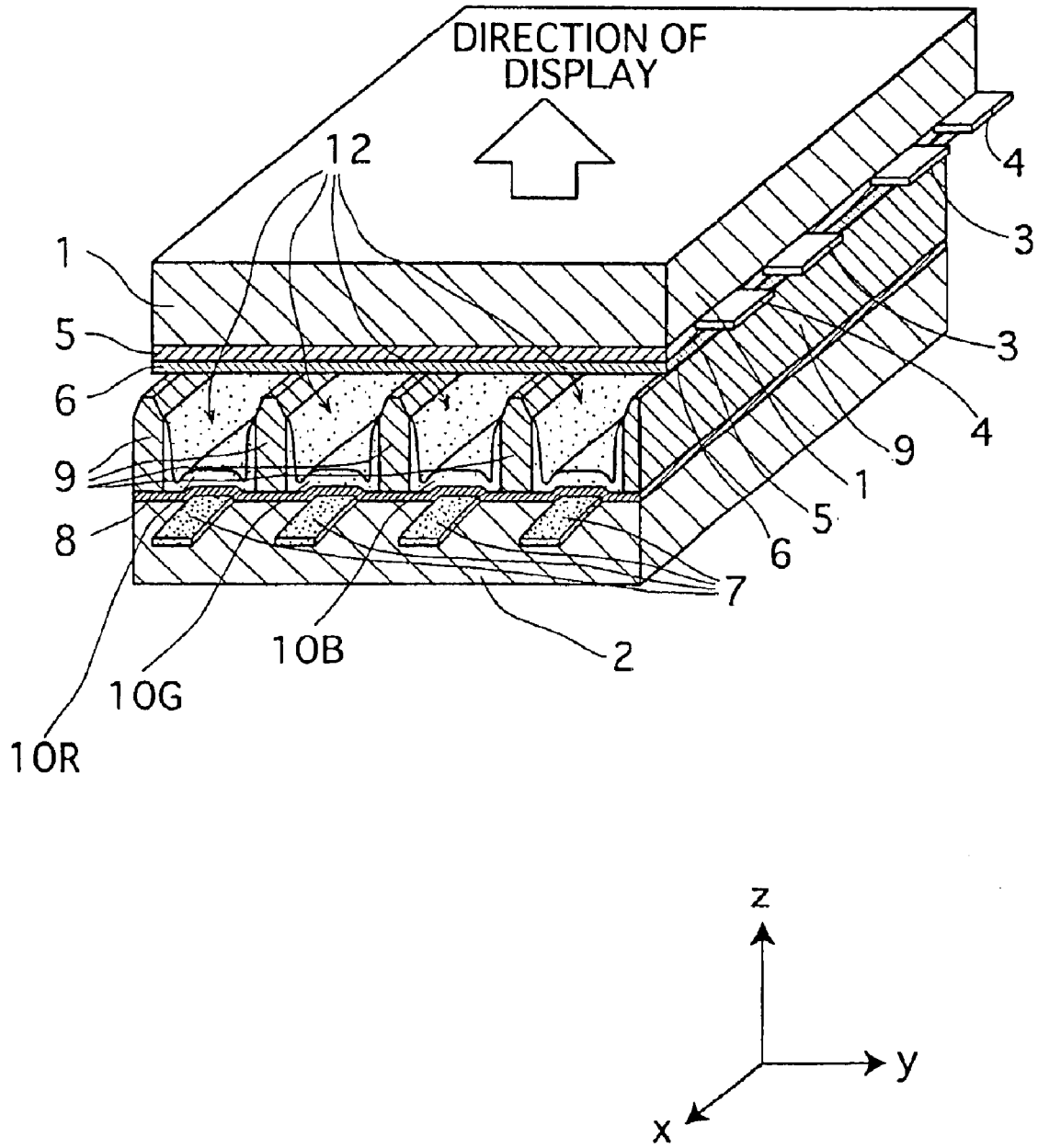
FIG. 2 is a perspective sectional view to show the structure of the image display fields of a PDP.

FIG. 1 is a schematic plan view of the PDP 100 from which a front glass substrate is removed and to which the driving method and the driving apparatus of the prevent invention are applied. FIG. 2 is a perspective sectional view to show the primary section of the image display fields 101 of the PDP 100. It should be noted that some of the sustain electrodes 3, scan electrodes 4, address electrodes 7 are omitted from the drawing to keep it simple. The following explains the structure of the PDP 100 with reference to FIGS. 1 and 2.

As shown in FIG. 1, the PDP 100 comprises at least a front glass substrate 1 (not shown in the drawing), a rear glass substrate 2, n pieces (n is an even number here) of sustain electrodes 3 (characters are attached to indicate an i'th electrode), n pieces of scan electrodes 4 (characters are attached to indicate an i'th electrode), m pieces of address electrodes 7 (characters are attached to indicate a j'th electrode), and a airtight sealing layer 11 shown as a diagonally shaded area. The PDP 100 has an electrode matrix with a tri-electrode structure in which a cell U is formed at each of the intersections of the electrodes 3, 4, and 7.

As shown in FIG. 2, the front glass substrate 1 and the rear glass substrate 2 are disposed in parallel being opposed to each other with a space therebetween. On the surface of the front glass substrate 1 facing the rear glass substrate 2, n pieces of sustain electrodes 3 and n pieces of scan electrodes 4 (only two pieces each are shown in the drawing) are disposed in parallel, one after another in the x direction (column direction) so that each electrode extends in the y direction (row direction) lengthwise. One sustain electrode and one scan electrode make one pair of display electrodes. Here, the sustain electrode 3 and the scan electrode 4 of the display electrodes in the i'th line are respectively positioned adjacent to the sustain electrode 3 and the scan electrode 4 of the display electrodes in the (i−1)'th line and the (i+1)'th line which are positioned adjacent to the i'th line in the x direction of the PDP. It means that the cells U can be divided into two groups such as (a) cells in which the sustain electrode 3 is positioned at a lower side of the cell in the x direction (in this embodiment, the "i" is an odd number, and hereafter such electrodes will be referred to as the a-group electrodes) and (b) cells in which the sustain electrode 3 is positioned at an upper side of the cell in the x direction (in this embodiment, the "i" is an even number, and hereafter such electrodes will be referred to as the b-group electrodes). As shown in FIG. 1, as for sustain electrodes 3, the sustain electrodes in the a-group which belong to the pairs with odd numbers and the sustain electrodes in the b-group which belong to the pairs with even numbers are electrically connected to each other within each group, and will be referred to as the a-group sustain electrodes 3*a* and the b-group sustain electrodes 3*b*. As for scan electrodes 4, each electrode is independent. As shown in FIG. 2, these sustain electrodes 3 and scan electrodes 4 are covered by a dielectric layer 5 made of glass or the like, and further covered by an MgO protective layer 6.

On the other hand, on the surface of the rear glass substrate 2 facing the front glass substrate 1, m pieces of address electrodes 7 (only four pieces are shown in the drawing) are disposed in stripes, and a dielectric layer 8 made of glass or the like is formed to cover the surface, and further, ribs 9 are formed along and between the address electrodes 7. The areas between two adjacent ribs 9 are coated with different phosphor materials 10R, 10G, and 10B in colors of Red (R), Green (G) and Blue (B) in a manner that the dielectric layer 8 over the address electrodes 7 is covered.

The front glass substrate 1 and the rear glass substrate 2 with such components formed thereon are assembled with ribs 9 intervening therebetween, keeping a distance from each other. A discharge space 12 is formed in the gaps, and as shown in FIG. 1, the glass substrates 1 and 2 are sealed with the airtight sealing layer 11 near the edges around them. Enclosed in the discharge space 12 is inert gas whose main constituent is for example Ne, and in which a small amount of xenon as a buffer gas is included.

With the arrangements explained so far, discharge cells are formed at each of the intersections of the electrodes 3 and 4 and the address electrodes 7, in the spaces between the front glass substrate 1 and the rear glass substrate 2, and it is possible to display images in the image display field 101, which is shown as a dotted area in FIG. 1.

General Structure of the PDP Driving Apparatus 200

Figure 3:
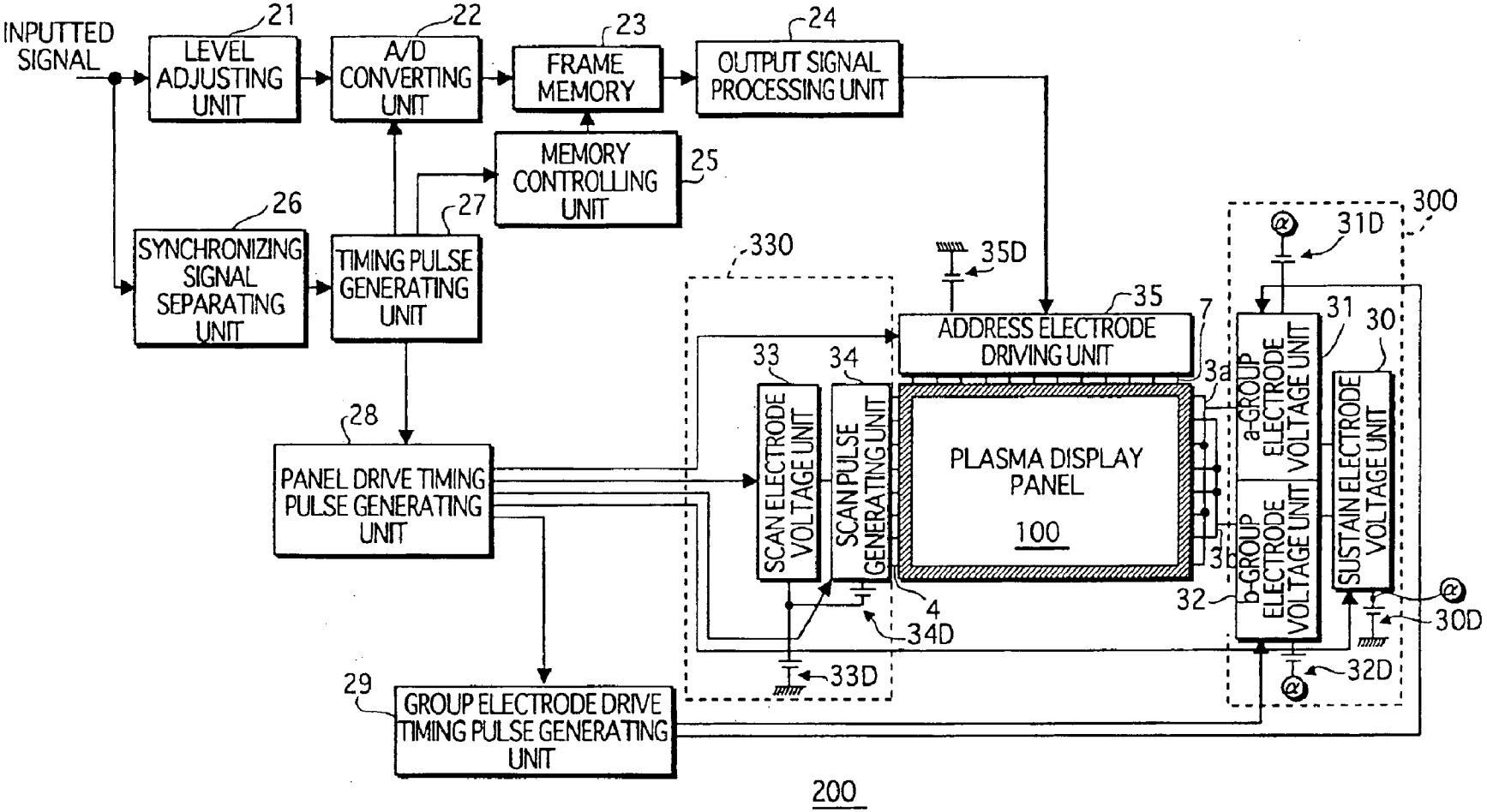
FIG. 3 is a block diagram of the PDP driving apparatus of the first embodiment.

FIG. 3 is a block diagram of a circuit to show the structure of the PDP driving apparatus 200 in the present invention.

As shown in the drawing, PDP driving apparatus 200 comprises the level adjusting unit 21, the A/D converting unit 22, the frame memory 23, the output signal processing unit 24, the memory controlling unit 25, the synchronizing signal separating unit 26, the timing pulse generating unit 27, the panel drive timing pulse generating unit 28, the group electrode drive timing pulse generating unit 29, the sustain electrode driving unit 300, the scan electrode driving unit 330, the address electrode driving unit 35, and is connected with the PDP 100 that it drives.

The level adjusting unit 21 adjusts the levels such as pedestal level (level of black) and white-balance level (balancing RGB levels) of inputted analog signals which include image signals and synchronizing signals and have been received by an external receiving apparatus, and then transmits the signals to the A/D converting unit 22.

The A/D converting unit 22 converts the image signals included in the level-adjusted inputted signals (analog) into digital image data corresponding to colors of Red (R), Green (G), and Blue (B), as well as outputs the image data to the frame memory 23 according to the timing pulse transmitted from the timing pulse generating unit 27.

The frame memory 23 includes a subframe data generating unit (not shown in the drawing) and generates multivalue subframe data indicating luminance levels (gray-scale levels) of Red (R), Green (G), and Blue (B) in each pixel from the transmitted image data, and once stores subframe image data segmented for each frame. Subsequently, the frame memory 23 outputs the image data to the output signal processing unit 24 according to the timing pulse transmitted from the memory controlling unit 25.

The output signal processing unit 24 is connected to each of the address electrodes 7 in the PDP 100, and processes the inputted image data in blocks that each correspond to a plurality of address electrodes 7, as well as outputs the processed image data to the address electrode driving unit 35 sequentially.

The memory controlling unit 25 transmits a timing pulse to the frame memory 23 on the basis of the timing pulse transmitted from the timing pulse generating unit 27 in order to control the timing by which the image data stored in the frame memory 23 is outputted to the output signal processing unit 24.

On the other hand, the inputted signals also get inputted to the synchronizing signal separating unit 26, where the synchronizing signals included in the inputted analog signals are separated and extracted, and then transmitted to the timing pulse generating unit 27.

The timing pulse generating unit 27 transmits a timing pulse to each of the A/D converting unit 22, the memory controlling unit 25, and the panel drive timing pulse generating unit 28 to be the drive timings of each of them, on the basis of the inputted synchronizing signals.

The panel drive timing pulse generating unit 28 is connected to the sustain electrode voltage unit 30, the scan electrode voltage unit 33, the scan pulse generating unit 34, the address electrode driving unit 35, and the group electrode drive timing pulse generating unit 29, and transmits to each of them a timing pulse to be the drive timings of each of them, on the basis of the inputted synchronizing signals.

The group electrode drive timing pulse generating unit 29 transmits to the a-group electrode voltage unit 31 and the b-group electrode voltage unit 32 timing pulses that drive them in a predetermined pattern (in this first embodiment, a pattern in which the a- and b-group electrode voltage units 31 and 32, are driven alternately), on the basis of the timing pulse transmitted from the panel drive timing pulse generating unit 28. It should be noted here that the panel drive timing pulse generating unit 28 and the group electrode drive timing pulse generating unit 29 are assembled into an LSI.

In the sustain electrode driving unit 300, the sustain electrode voltage unit 30, the a-group electrode voltage unit 31, and the b-group electrode voltage unit 32 are connected with each other in series with use of the floating ground system, and it is arranged so that the outputs from (i) the sustain electrode voltage unit 30 and the a-group electrode voltage unit 31, and (ii) the sustain electrode voltage unit 30 and the b-group electrode voltage unit 32 can be respectively added up. Such a connected circuit in which voltages are added up is publicly known and disclosed in Japanese Laid-Open Patent Application Publication No. 9-311661. Detailed explanation of the structure will be therefore omitted.

The sustain electrode voltage unit 30 has a power supply 30D that applies a voltage (Voltage: Va (=Vc)) thereto, and is connected to the a-group electrode voltage 31 and the b-group electrode voltage 32. The sustain electrode voltage unit 30 applies to the a- and b-group electrode voltage units 31 and 32 the voltage Va, which becomes a base of the voltage to be applied to the a-group sustain electrodes 3*a* and the b-group sustain electrodes 3*b* in the PDP 100, according to the timing pulse transmitted from the panel drive timing pulse generating unit 28 during an address period. The sustain electrode voltage unit 30 generates a sustain discharge pulse during a sustain discharge period.

The a-group electrode voltage unit 31 and the b-group electrode voltage unit 32 have the power supplies 31D and 32D which are connected to the power supply 30D at points indicated with "@" with use of the floating ground system, and are connected to the a-group sustain electrodes 3*a* and the b-group sustain electrodes 3*b* in the PDP 100 respectively. The a- and b-group electrode voltage units 31 and 32 apply a necessary voltage to both the a-group sustain electrodes 3*a* and the b-group sustain electrodes 3*b* by superposing a voltage of negative polarity, which is −(Va−Ve), on the base voltage Va applied by the sustain electrode voltage unit 30, according to the timing pulse transmitted from the group electrode drive timing pulse generating unit 29.

In the scan electrode driving unit 330, the scan electrode voltage unit 33 and the scan pulse generating unit 34 are connected to each other in series with use of the floating ground system, and it is arranged so that the output voltages from these are added up. Such a connected circuit in which voltages are added up is publicly known and disclosed in the publication PCT/JP99/03873. Detailed explanation of the structure will be therefore omitted.

The scan electrode voltage unit 33 has a power supply 33D that applies a voltage (Voltage: Vb+Vc) thereto, and is connected to the scan pulse generating unit 34. The scan electrode voltage unit 33 generates an initialization pulse for general use during an initialization period, and a sustain discharge pulse to be applied to the scan electrodes 4 during a sustain period, according to the timing pulse transmitted from the panel drive timing pulse generating unit 28.

The scan pulse generating unit 34 has the power supply 34D (Voltage: −Vb) connected to the power supply 33D with use of the floating ground system, and is connected to each of the scan electrodes 4 in the PDP 100. The scan pulse generating unit 34 applies a scan pulse (Voltage: −Vb) to each of the scan electrodes 4(1), 4(2), . . . 4(*n*) sequentially, according to the timing pulse transmitted from the panel drive timing pulse generating unit 28 during an address period. (At this time, the scan electrode voltage unit 33 is not driven, and is maintained at 0V).

The address electrode driving unit 35 is connected to a power supply 35D (Voltage: Vd) that applies a voltage thereto and each of the address electrodes 7 in the PDP 100, and has basically the same arrangement as the one discussed in the Japanese Laid-Open Patent Application Publication No. 7-325552 etc. The address electrode driving unit 35 applies an address pulse to each of the address electrodes 7 that correspond to the data transmitted from the output signal processing unit 24, according to the timing pulse transmitted from the panel driving timing pulse generating unit 28.

PDP Driving Method in General

Before explaining the driving method of the PDP driving apparatus 200, a general driving method used to display an image on a PDP will be explained.

The driving method generally used for displaying multi grayscale levels on a PDP is known as "the intraframe time-division grayscale display method" by which one frame is divided into a plurality of subframes and the middle grayscale level can be expressed with combinations of light on and light off in each subframe.

Figure 4:
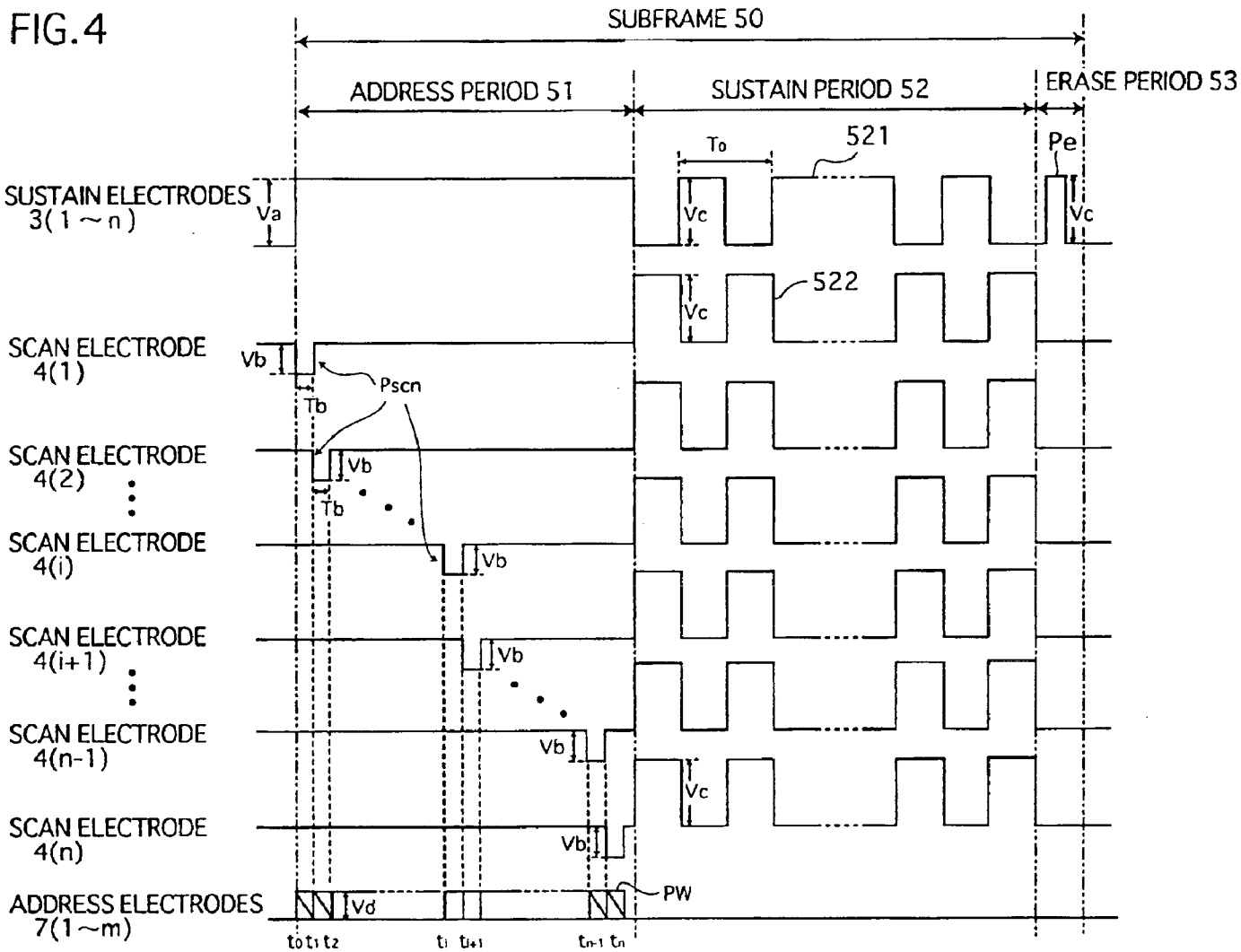
FIG. 4 is a timing chart to show a driving method for a PDP in the prior art.

FIG. 4 shows an example of a timing chart for the subframes in the driving method in which "the intraframe time-division grayscale display method" is used. The horizontal axis shows the time, and the vertical axis shows the voltage.

In the driving method shown in the drawing, the subframe 50 is made up of (i) an address period 51 of a certain length during which an address discharge is generated in all the cells, (ii) a sustain period 52 which is a period of time whose length corresponds to the relative ratio of the luminance of the cells that emit light, and (iii) an erase period 53 during which the wall charges in all the cells are cancelled, and the sustain discharges are stopped.

For instance, in order to have the PDP 100 in FIG. 1 display an image, a scan pulse Pscn (Voltage: −Vb, Time: Tb) is applied to each of the scan electrodes 4(1) through 4(*n*) sequentially one line at a time during the address period 51.

At this time, a voltage Va is applied to all the sustain electrodes 3 throughout the address period 51, and also an address pulse Pw (Voltage: Vd, Time: Tb) is applied to such address electrodes 7 of the cells that are to emit light. This process causes a micro-discharge between the scan electrode 4 and the address electrode 7 of the cells that are to emit light. Then, this micro-discharge triggers another micro-discharge between the sustain electrode 3 and the scan electrode 4 (hereafter, these discharges together will be referred to as an address discharge), and a wall charge is accumulated in each of those cells. Subsequently, in the sustain period 52, the sustain pulses 521 and 522, which each have rectangular waves with a voltage Vc and a cycle T0, are applied to each of the sustain electrodes 3 and each of the scan electrodes 4 throughout the panel at the same time, one pulse being staggered from the other pulse by half a cycle. In each of the cells having discharges where a wall charge has been generated, the discharges that occur repeatedly are sustained. Because of these discharges, ultraviolet rays are generated from the discharge gas enclosed in the PDP 100, and the phosphor materials 10R, 10G, and 10B (FIG. 2) get excited and emit light. Subsequently, in the erase period 53, the wall charges get cancelled by an erase pulse Pe (e.g. Voltage: Vc) applied to each of all the sustain electrodes 3.

In FIG. 1 for the first embodiment, the sustain electrodes 3 are divided into b-group sustain electrodes 3*b* and the a-group sustain electrodes 3*a* which can be independently driven; however, if these are not divided and are connected electrically in common, there is a possibility that an error address discharge may occur at where sustain electrodes are adjacent to each other, as will be later explained, because the electric potentials of all the sustain electrodes are the same.

FIGS. 5A through 5D show the arrangement of a sustain electrode 3, a scan electrode 4, and an address electrode 7 as being viewed from the side of the PDP, to indicate how an address discharge is generated on the scan electrode 4(*i*) during the address period 51, and the process progresses from 5A to 5D.

Figure 5A:
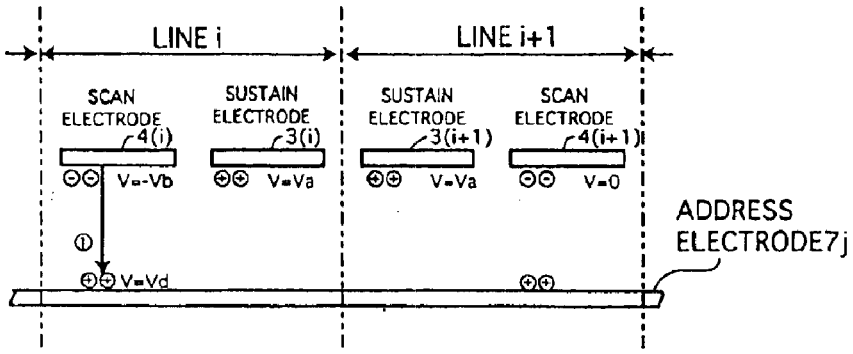
FIGS. 5A through 5D show the arrangement of electrodes at times of address discharges from a side of the PDP to which a driving method of the prior art is applied.
Figure 5B:
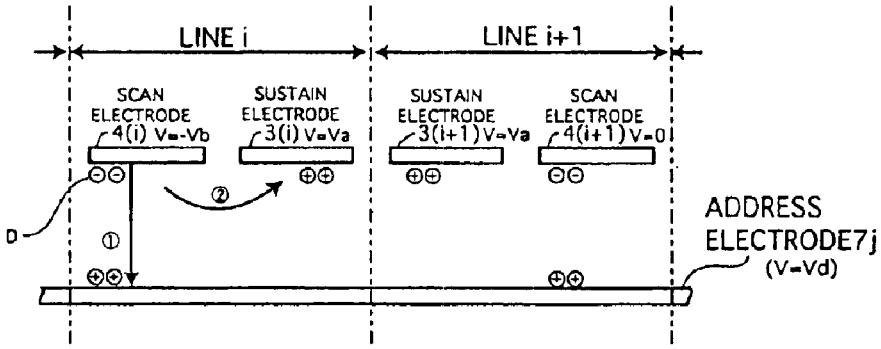
Figure 5C:
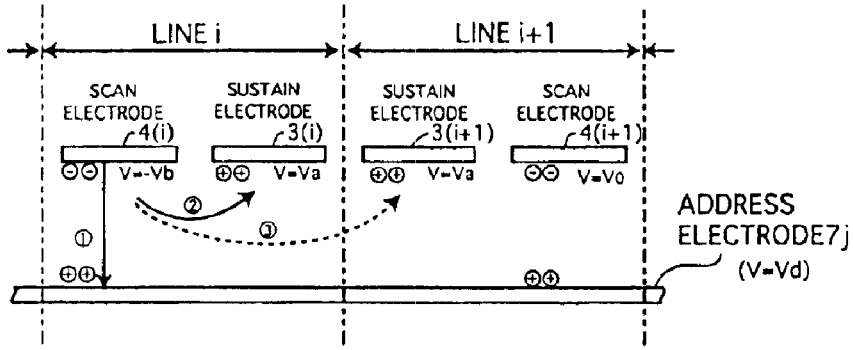

Generally speaking, since an initializing discharge (not shown in the drawings) had been generated by a scan pulse of the positive polarity applied to the scan electrodes 4 prior to the address period 51 (FIG. 4), a negative charge is generated on the scan electrode 4(*i*) and a positive charge is generated on both the sustain electrode 3(*i*) and the address electrode 7 as shown in FIG. 5A. Here, when a voltage −Vb is applied to the scan electrode 4(*i*) and a voltage Vd is applied to the address electrode 7(*j*), a discharge indicated with ① in FIG. 5B occurs. This discharge ①, being a trigger, at substantially the same time induces another discharge between the scan electrode 4(*i*) and the sustain electrode 3(*i*) as indicated with ② in the drawing. At this time, since a voltage Va is applied to each of all the sustain electrodes 3, there is a possibility that the potential difference between the scan electrode 4(*i*) and the sustain electrode 3(i+1) belonging to the adjacent cell may be over the breakdown voltage, and that a discharge indicated with ③ in FIG. 5C may occur. It should be noted here that the discharges indicated with ① through ③ in the FIGS. 5A, 5B, and 5C are shown in stages; however, they occur at substantially the same time.

Figure 5D:
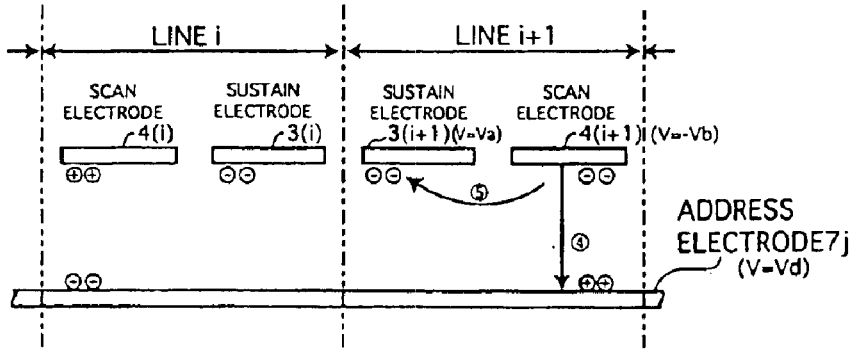

These discharges ① through ③ reverse the charges at the electrodes, and the charges near the electrodes become as in FIG. 5D. Here, the discharge ③ generates a negative charge on the sustain electrode 3(i+1) of the cell in the (i+1)'th line, which is the cell that has not had an address discharge yet, and causes the quantity of electric charge in that cell to change. In this manner, if the quantity of electric charge in a cell has changed prior to an address discharge, then, at a time of the address discharge ("ti+1" to "ti+2"), the discharge ④ may occur, but the discharge ⑤ may not occur since the charges generated on the sustain electrode 3(i+1) and the scan electrode 4(i+1) will be both negative as shown in FIG. 5D, and thus the address discharge may not be generated properly.

Driving Method for PDP 100

Figure 6:
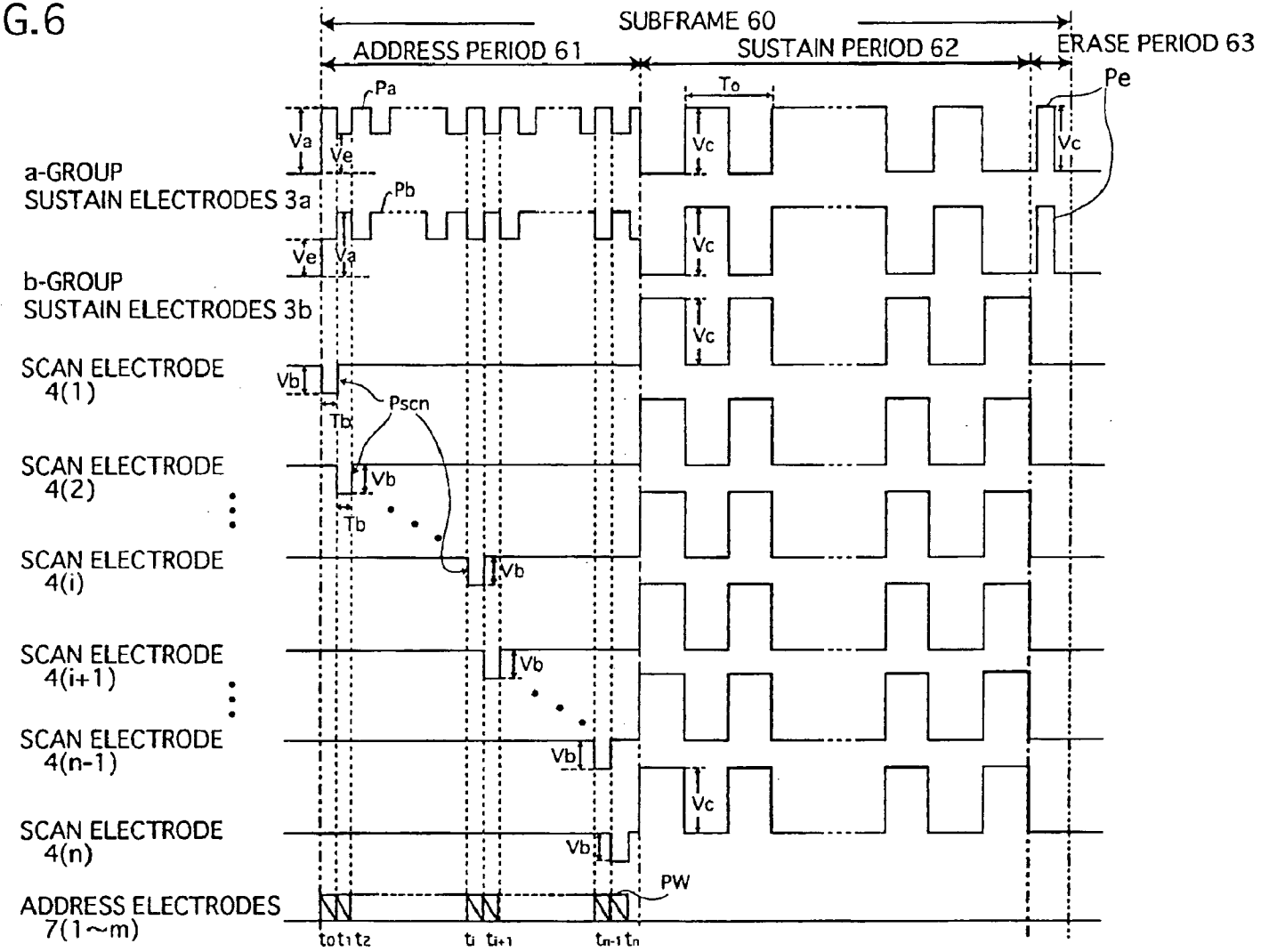
FIG. 6 is a timing chart to show a driving method for a PDP in the first embodiment.

The following explains the driving method for the PDP 100 of the first embodiment. FIG. 6 is an example of a timing chart, for the subframe 60 in the driving method in which "the intraframe time-division grayscale display method" is used, that shows the driving method for the PDP 100 of the first embodiment. The horizontal axis shows the time, and the vertical axis shows the voltage. The timing chart in FIG. 6 differs from the timing chart in FIG. 4 only in the pulse to be applied to the sustain electrodes; therefore, explanation on the items that have the same characters attached as in the FIG. 4 will be omitted.

As shown in the drawing, the driving method for the PDP 100 of the first embodiment differs in that pulses of different voltages are applied to the a-group sustain electrode 3*a* and the b-group sustain electrode 3*b* during the address period 61, instead of voltages of the same level being applied to all the sustain electrodes 3 at the same time.

During the address period 61, the pulse Pa applied to the a-group sustain electrodes 3*a* and the pulse Pb applied to the b-group sustain electrodes 3*b* are to apply a voltage Va for a period of Tb respectively; i.e. the pulses Pa and Pb are alternately applied to the a-group and b-group sustain electrodes, 3*a* and 3*b*. Here, during the address period 61, the pulse Pa is applied to the a-group sustain electrodes 3*a* so that the phase is staggered by half a cycle from the pulse Pb applied to the b-group sustain electrodes 3*b*. When the pulses Pa and Pb are not applied, a voltage Ve (Ve<Va) is applied to each of the a- and b-group sustain electrodes 3*a* and 3*b*.

More specifically, when an address discharge is generated on the display electrodes in the i'th line (where "i" is an odd number), it is arranged so that a voltage −Vb is applied to the scan electrode 4(*i*), and a voltage Va is applied to the a-group sustain electrodes 3*a*, one of which is paired up with the scan electrode 4(*i*), whereas a voltage Ve being lower than the voltage Va is applied to the b-group sustain electrodes 3*b* that are positioned adjacent to the a-group sustain electrodes 3*a*. Additionally, it is easy to set the potential difference between the a-group sustain electrodes 3*a* and the b-group sustain electrodes 3*b* as a fixed and large value due to the rectangular waves with the staggered by half a cycle.

Figure 7:
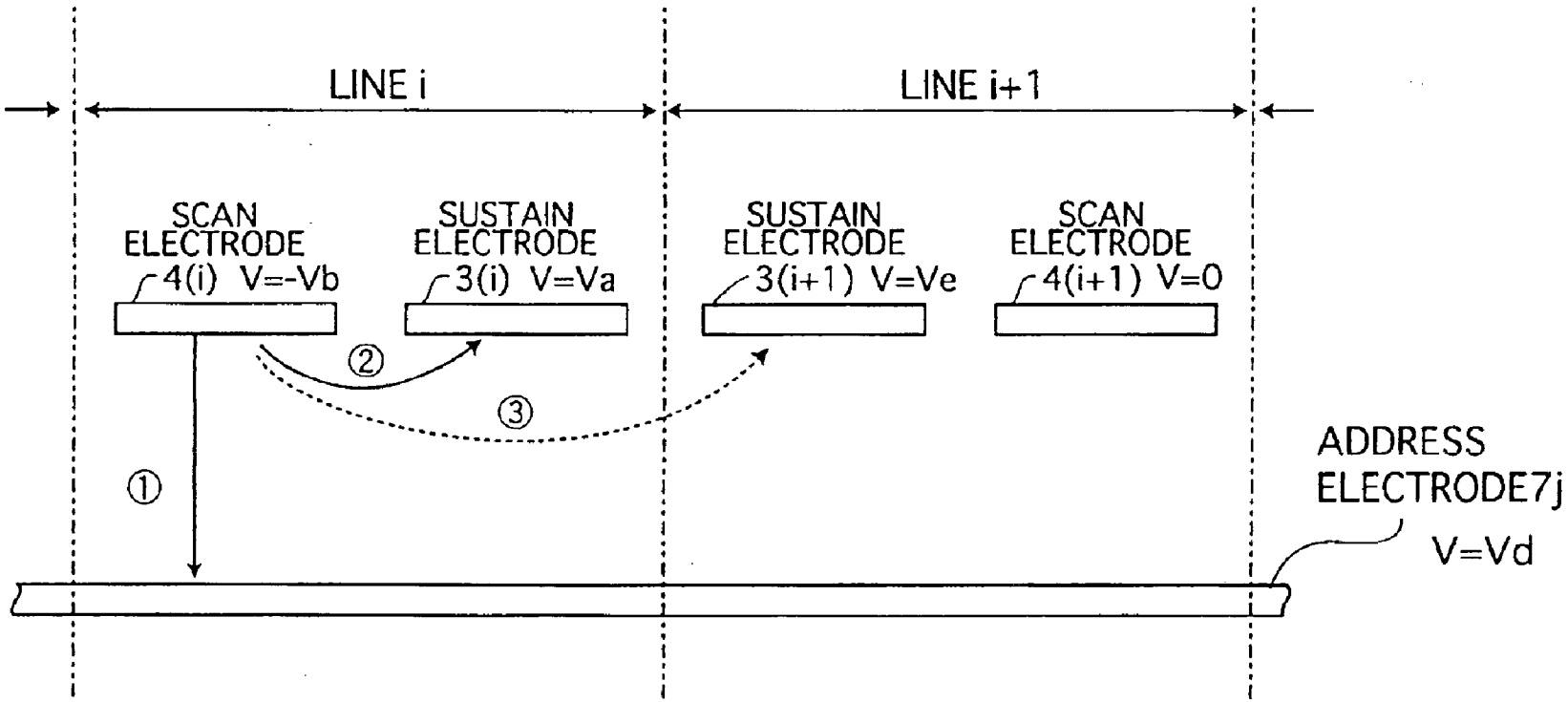
FIG. 7 shows the arrangement of electrodes at times of address discharges from a side of the PDP.

FIG. 7 shows the arrangement of the sustain electrodes, the scan electrodes, and the address electrodes to explain how discharges occur at times of address discharges.

As shown in the drawing, when an address discharge is generated on the display electrodes in the i'th line, a voltage Va is applied to the sustain electrode 3(*i*) of that cell and a voltage Ve being lower than the voltage Va is applied to the sustain electrode 3(i+1) which is in the (i+1)'th line and is of the adjacent cell; therefore, the potential difference between the scan electrode 4(*i*) and the sustain electrode 3(i+1) is smaller than in the prior art, and the discharge ③ is less likely to occur than in the prior art.

Conversely, when an address discharge is generated on the display electrodes in the line of an even number, as shown in FIG. 6, it is arranged so that a voltage Va is applied to the b-group sustain electrodes 3*b*, and a voltage Ve being lower than the voltage Va is applied to the a-group sustain electrodes 3*a;* therefore, in the same manner as mentioned above, it is possible to inhibit an error discharge indicated as ③ in FIG. 7 by which the wall charge of an adjacent cell is changed, as well as to inhibit occurrence of improper discharges which could happen incidentally.

Thus, as a way of inhibiting occurrence of such improper discharges, if the potential difference Ve−(−Vb) between the scan electrode 4(*i*) and the sustain electrode 3(i+1) shown in FIG. 7 can be made smaller than the breakdown voltage between the scan electrode 4(*i*) and the sustain electrode 3(*i*), then it is possible to make the discharge ③ less likely to occur. For the purpose of making the potential difference smaller, one of the options is to establish a ground instead of applying a voltage to the sustain electrode 3(i+1); another option is to apply a higher voltage (with a lower absolute value) to the sustain electrode 3(i+1) than to the adjacent sustain electrode 3(*i*) having the address discharge, in the case where a voltage of the positive polarity is applied to the scan electrodes 4 and a voltage of the negative polarity is applied to the sustain electrodes 3 at a time of an address discharge.

In order to make such a difference between the voltages applied to the sustain electrodes 3 having address discharges and the sustain electrodes 3 positioned adjacent to each of them, that is to say, the sustain electrodes 3 in the line of an odd number (a-group) and in the line of an even number (b-group), the PDP driving apparatus 200 of the first embodiment comprises the a-group electrode voltage unit 31 and the b-group electrode voltage unit 32 (FIG. 3) that respectively drive the a-group sustain electrodes 3*a* and the b-group sustain electrodes 3*b,* and it is arranged so that these voltage units are connected to each of the electrodes. Further, the group electrode drive timing pulse generating unit 29 is provided to generate a timing pulse for driving these electrode voltage units 31 and 32 so that these electrode groups 3*a* and 3*b* can be driven separately. This way, it is possible to actualize the driving method and inhibit occurrence of improper address discharges in the PDP because the quantity of electric charges accumulated near the sustain electrode in an adjacent cell does not get changed by an improper discharge at a time of an address discharge, unlike the prior art. Consequently, it is possible to inhibit occurrence of improper discharges even if the pitch between the cells are small, and this driving method is therefore suitable for PDPs of fine display quality.

In addition, in the first embodiment, two voltage units such as the a-group electrode voltage unit 31 and the b-group electrode voltage unit 32 are provided; however, the invention is not limited to that, and can be embodied by providing an electrode voltage unit individually for each of the electrodes because it is also possible to drive the a-group sustain electrodes 3*a* and the b-group sustain electrodes 3*b* separately that way.

Second Embodiment

Next, the PDP driving apparatus and driving method of the second embodiment will be explained. It should be noted that the PDP driving apparatus and driving method of the second embodiment are the same as the ones in the first embodiment except for the driving method explained with FIG. 6; therefore the explanation will mainly focus on the PDP driving method.

Figure 8:
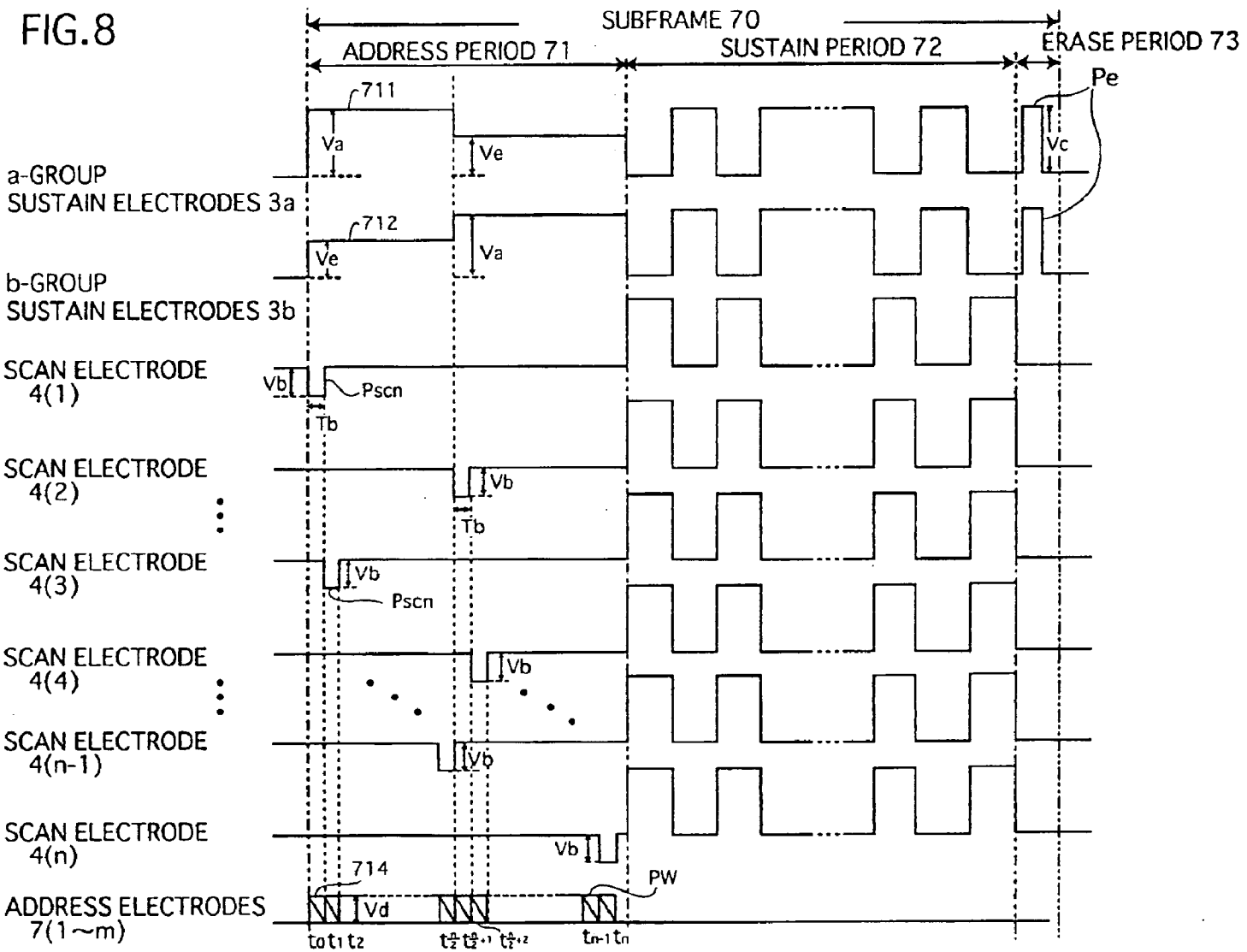
FIG. 8 is a timing chart to show a driving method for a PDP in the second embodiment.

FIG. 8 is an example of a timing chart, for the subframe 70 in the driving method in which "the intraframe time-division grayscale display method" is used, that shows the driving method for the PDP of the second embodiment. The horizontal axis shows the time, and the vertical axis shows the voltage.

The driving method shown in this drawing differs from the one shown in FIG. 6 in the pulse to be applied to each of the electrodes during the address period 71; the pulses to be applied during the sustain period 72 and the erase period 73 are the same, so explanation on these periods will be omitted.

As shown in the drawing, unlike the first embodiment where address discharges are generated sequentially starting from the scan electrode 4 (FIG. 1) in the first line, the driving method of the second embodiment is arranged so that firstly address discharges are generated in each of the cells belonging to one of the groups in which the scan electrodes 4 are positioned on the same side (i.e. the scan electrodes in the odd number lines in this embodiment), and secondly address discharges are generated in each of the cells belonging to the other group (i.e. the scan electrodes in the even number lines in this embodiment).

At first, the pulse 711 (Voltage: Va) is applied to the a-group sustain electrodes 3*a* starting from Time t0, which is the beginning of the address period 71, and the voltage will be maintained; the pulse 712 (Voltage: Ve) having a lower voltage than the pulse 711 is applied to the b-group sustain electrode 3*b,* and the voltage will be maintained; and a rectangular-wave scan pulse Pscn (Voltage: −Vb, Time: Tb) is applied until Time t1 to the scan electrode 4(1) which is in the odd number line. At this time, a rectangular-wave address pulse Pw (Voltage: Vd, Time: Tb) is applied to the address electrode 7 of the cells having address discharges. This way, the address discharges for the first line are completed.

Secondly, from Time t1 to t2, the same scan pulse Pscn as the one applied to the first line is applied to the scan electrode 4(3) in the third line which is an odd number line, instead of to the scan electrode 4(2) in the second line. The same will be repeatedly performed on the scan electrodes in the odd number lines until Time $T_{n/2}$ so that the scan pulse Pscn is applied to each of all the scan electrodes 4 in the odd line numbers. By doing so, an address discharge is generated on each of the display electrodes in the odd number lines. At the time of this address discharge, since the voltage Ve being lower than the voltage Va is applied to the sustain electrodes 3*b* in the even number lines belonging to the cells positioned adjacent, it is possible to inhibit an address discharges from spreading over to the sustain electrode that belongs to an adjacent cell. Thus, it is possible to inhibit occurrence of improper address discharges like in the first embodiment.

Next, an address discharge will be generated starting from Time $t_{n/2}+1$ on the display electrodes in the even number lines in the same way as for the display electrodes in the odd number lines. At this time, the voltages to be applied are interchanged between the sustain electrodes 3*a* in the odd number lines and the sustain electrodes 3*b* in the even number lines. It means that the voltage Ve is applied to the a-group sustain electrodes 3*a* and the voltage Va is applied to the b-groups sustain electrodes 3*b*. By doing so, it is possible to inhibit occurrence of improper address discharges in the same manner as the display electrodes in the odd number lines.

Further, unlike the first embodiment where the voltage to be applied to the sustain electrodes 3 is changed for every line of the display electrodes at times of address discharges, in the second embodiment, the voltage to be applied to the sustain electrodes 3 is changed only once at Time $t_{n/2}+1$. Thus, it is possible to reduce electricity consumption required for charges and discharges of the panel electrostatic capacitance loads, that is to say reduce ineffective electricity, which is electricity that does not contribute to generating the discharges, compared to the case of the first embodiment.

In addition, in the second embodiment, the scan pulse is applied to the scan electrodes 4 in the odd number lines first; however, it is also possible to reverse the order and apply the scan pulse Pscn to the scan electrodes 4 in the even number lines first. In such a case, the voltages to be applied to the sustain electrodes 3 in the even number lines and in the odd number lines need to be reversed as well. Furthermore, in the second embodiment, it is arranged so that the voltage to be applied to the sustain electrodes 3 is changed only once, but the invention is not limited to this; the voltage to be applied to the sustain electrodes 3 would be changed less number of times than in the first embodiment as long as it is arranged so that address discharges are generated sequentially on the sustain electrodes belonging to the same group, that is to say, either a-group sustain electrodes 3*a* or b-group sustain electrodes 3*b*, and thus it is possible to reduce power consumption that way.

Third Embodiment

Next, the PDP driving apparatus and driving method of the third embodiment will be explained. Basically, the PDP driving apparatus and driving method of the third embodiment are substantially the same as those in the first embodiment, except for the structure of the PDP to be driven and the driving method explained with FIG. 6; therefore the explanation will mainly focus on the PDP structure and the PDP driving method.

Before starting the main explanation, the PDP to be driven by the PDP driving apparatus of the third embodiment will be explained. The PDP to be driven in the third embodiment has basically the same structure as the PDP 100 explained with FIGS. 1 and 2 in the first embodiment, except that in some parts of the panel, there are some cells in which the sustain electrodes in the odd number lines belong to the b-group instead, and the sustain electrodes in the even number lines belong to the a-group instead. Accordingly, the operation of the drive timing pulse generating unit 29 is also different.

Figure 9:
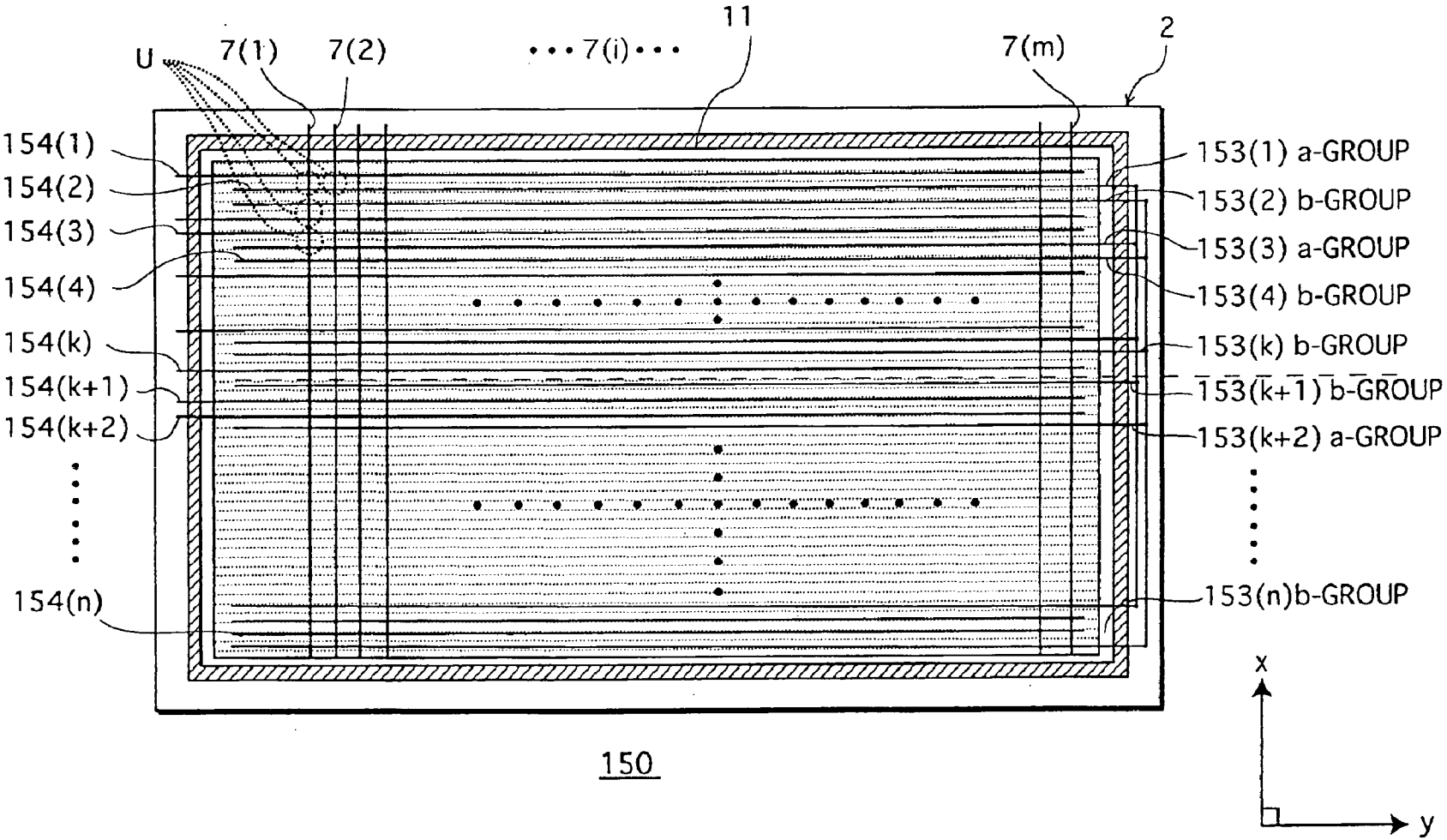
FIG. 9 is a schematic plan view of a PDP from which the front glass substrate is removed and to which the driving method and the driving apparatus of the third embodiment are applied.

FIG. 9 is a schematic plan view of the PDP 150 to be driven in the third embodiment from which the front glass substrate is removed. It should be noted that explanation on the items that have the same characters attached as in the FIG. 1 will be omitted.

As shown in the drawing, the sustain electrodes 153 and the sustain electrodes 154 are both disposed in the same way as in FIG. 1 from the first line to the k'th line of the display electrodes (here, on the premise that k=an even number), and the sustain electrodes 153 in the odd number lines belong to the a-group and the sustain electrodes 153 in the even number lines belong to the b-group.

In and after the (k+1)'th line of the display electrodes, the sustain electrodes 153 in the odd number lines belong to the b-group, that is to say, the sustain electrode 153 is disposed on the upper side of the scan electrode 154 in the x direction in each cell. (The sustain electrodes 153 in the even number lines belong to the a-group.) It should be noted here that the sustain electrodes 153 are electrically connected within each group, such as the a-group and the b-group, in the same manner as in the first embodiment.

Figure 10:
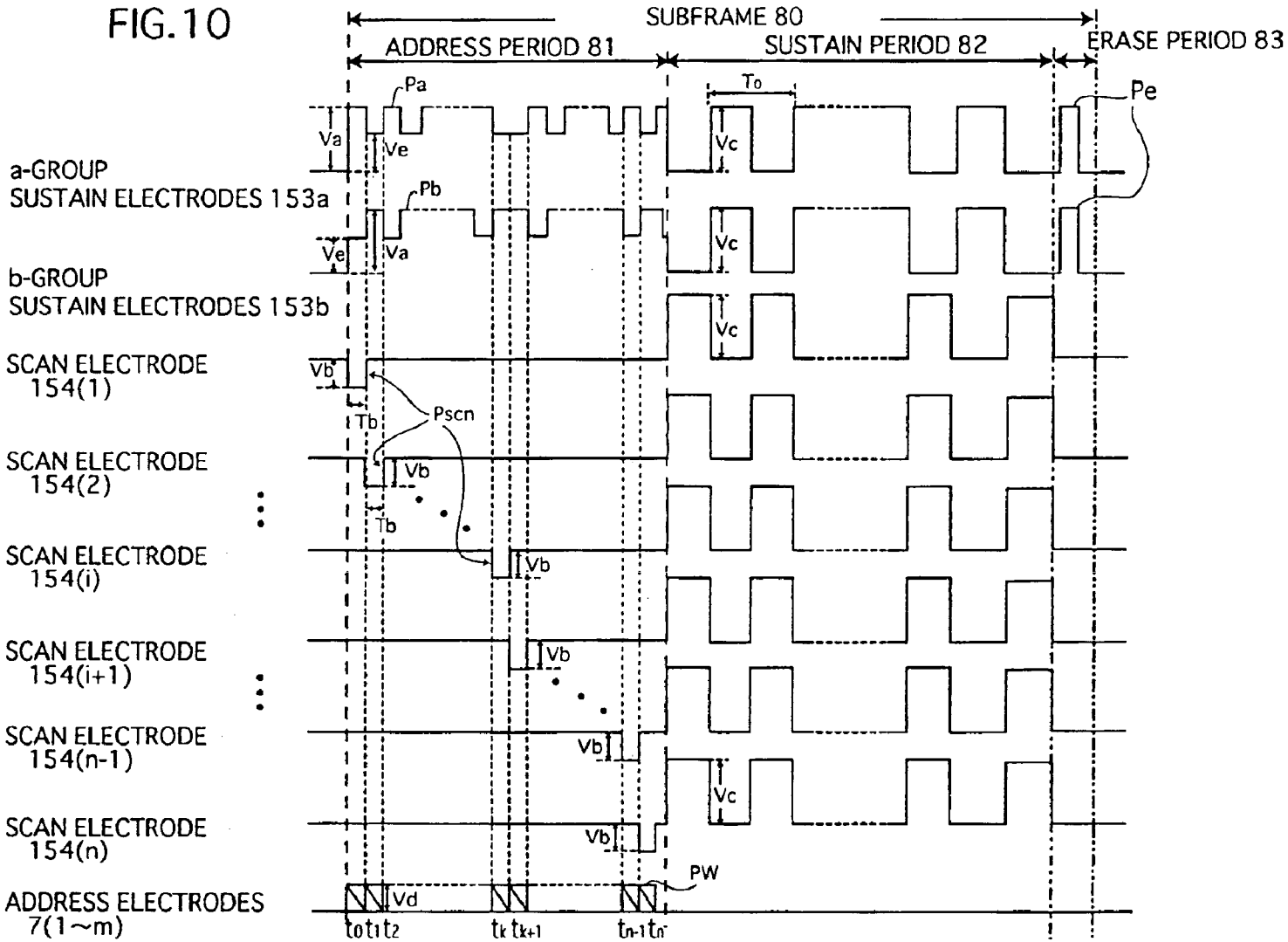
FIG. 10 is a timing chart to show a driving method for a PDP in the third embodiment.

FIG. 10 is an example of a timing chart, for the subframe 80 in the driving method in which "the intraframe time-division grayscale display method" is used, that shows the driving method of the third embodiment. The horizontal axis shows the time, and the vertical axis shows the voltage.

The driving method shown in this drawing differs from the one shown in FIG. 6 in the pulses to be applied to the sustain electrodes 153 during the address period 81; the pulses to be applied during the sustain period 82 and the erase period 83 are the same, so explanation on these periods will be omitted.

As shown in the drawing, an address discharge is generated in each cell by applying voltages in the same manner as shown in FIG. 6 until Time tk when a voltage is applied to the display electrodes in the k'th line. At Time tk, it is arranged so that the voltage Va is applied to the b-group sustain electrodes 153*b*, and the voltage Ve being lower than the voltage Va is applied to the a-group sustain electrodes 153*a*.

Next, at Time t(k+1) when it comes to the (k+1)'th line where the display electrodes are disposed differently and the sustain electrode 153 belongs to the b-group, the voltage Va keeps being applied to the b-group sustain electrodes 153*b*, whereas the voltage Ve is applied to the a-group sustain electrodes 153*a*. It means that, in and after the (k+1)'th line of the display electrodes, the rectangular waves to be applied to the a-group sustain electrodes 153*a* and the b-group sustain electrodes 153*b* are staggered by half a cycle from those of up to Time tk. This is done by changing the setting of the timing pulses outputted by the group electrode drive timing pulse generating unit 29 shown in FIG. 3.

Here, since the sustain electrode 153(k+1) is not positioned adjacent to the sustain electrode 153(*k*) belonging to the adjacent cell (in the k'th line), it is assumed that an improper address discharge is not likely to occur in these lines. In addition, in and after the (k+2)'th line, the voltage applied to the sustain electrode 153 having an address discharge is higher than the voltage applied to the sustain electrode 153 positioned adjacent to that sustain electrode, just like up to the k'th line, it is therefore possible to inhibit occurrence of improper address discharges as in the first embodiment.

It should be noted here that in the third embodiment it is discussed that there are two areas in which electrodes are disposed in different orders from each other, the two areas being (i) from the first line to the k'th line, and (ii) from the (k+1)'th line to the n'th line of the display electrodes; however, the same effect is available also when applying the present invention to a case where there are three or more areas in which electrodes are disposed in different orders from each other.

Modifications (1) In the embodiments discussed above, the timing pulses for driving the a-group electrode voltage unit 31 and the b-group electrode voltage unit 32 are transmitted from the group electrode drive timing pulse generating unit 29; however, it is also possible that the timing pulses are transmitted by some other arrangements.

Figure 11:
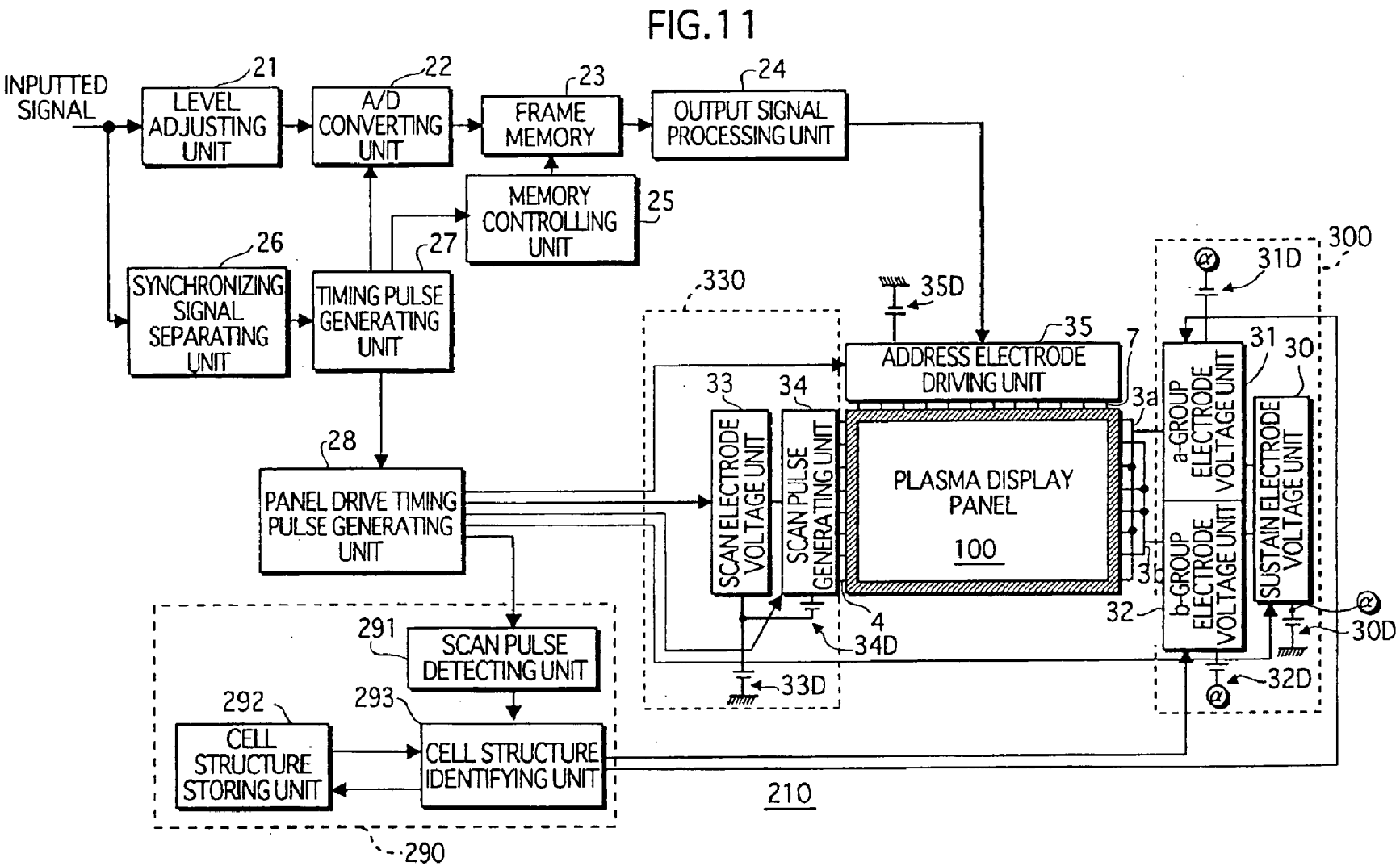
FIG. 11 is a block diagram for a PDP driving apparatus in a modification.

FIG. 11 is a block diagram to show the structure of the PDP driving apparatus 210. In this modification example, the arrangements are the same as the FIG. 3 except for the group electrode drive timing pulse generating unit 29; therefore explanation on the same arrangements will be omitted.

As shown in the section indicated with a dotted line, the PDP driving apparatus 290 comprises the group electrode drive timing pulse generating unit 29 which includes the scan pulse detecting unit 291, the cell structure storing unit 292, and the cell structure identifying unit 293.

The scan pulse detecting unit 291 detects on which line of the scan electrodes 4 in the PDP there is an instruction for applying a scan pulse, according to the scan pulse timing transmitted from the panel drive timing pulse generating unit 28, and transmits the result of the detection to the cell structure identifying unit 293.

The cell structure storing unit 292 stores in advance a table that indicates (i) the line numbers of the scan electrodes 4 and (ii) in combination with which sustain electrode, either an a-group sustain electrode 3*a* or a b-group sustain electrode 3*b,* each of the scan electrodes 4 with those line numbers forms a cell in the PDP connected.

By referring to the table stored in the cell structure storing unit 292 with regard to the result transmitted from the scan pulse detecting unit 291, the cell structure identifying unit 293 determines the drive timings of the a-group electrode voltage unit 31 and the b-group electrode voltage unit 32, and applies a drive timing pulse to each of the voltage units 31 and 32.

Figure 14:
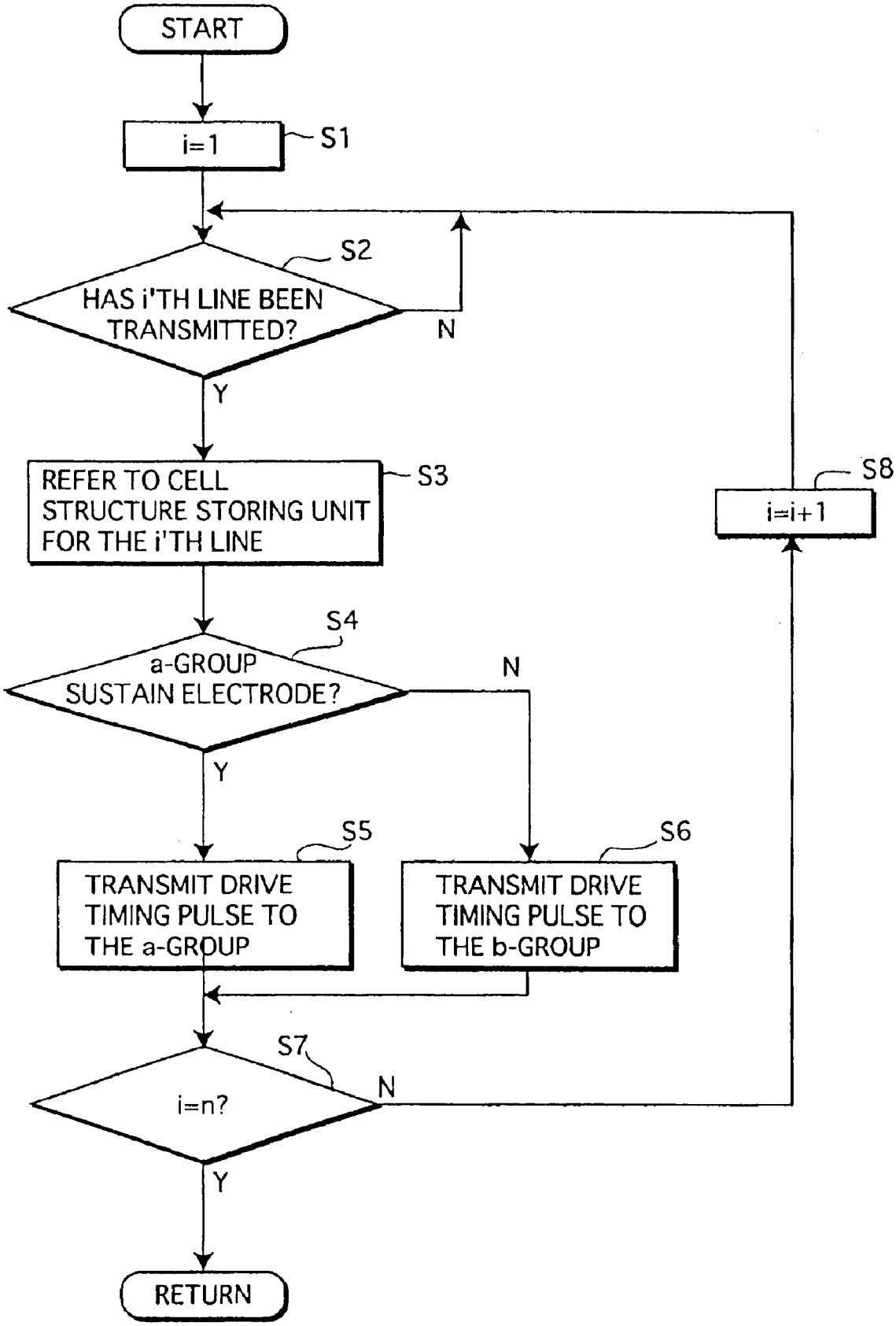
FIG. 14 is a flowchart showing the control of the cell structure identifying unit in a modification.

FIG. 14 is a flowchart showing the control of the cell structure identifying unit 293.

As shown in the drawing, at first, it is set as i=1 (Step S1). Next, it is judged if a scan pulse is applied to the scan electrode 4 in the (i=1)'th line, on the basis of the signal transmitted from the scan pulse detecting unit 291, and wait till a scan pulse is applied to the (i=1)'th line. (Step S2: N). Here, when it is judged that a scan pulse is applied to the scan electrode 4 in the (i=1)'th line (Step S2: Y), the table stored in the cell structure storing unit 292 is referred to (Step S3), and it is judged if the sustain electrode 3 in the (i=1)'th line is an a-group sustain electrode 3*a* (Step S4). When it is judged in the affirmative (Step S4: Y), a drive pulse is transmitted to the a-group electrode voltage unit 31 (Step S5), and when it is judged in the negative (Step S4: N), a drive pulse is transmitted to the b-group electrode voltage unit 32 (Step S6). When "i=n" is not satisfied (Step S7: N), i is incremented by 1 (Step S7→Step S8→Step S2), and the process is repeated till i=n is satisfied so that an address discharge is generated on all of the display electrodes. When i=n is satisfied, it is judged that an address discharge is generated on all of the display electrodes, and the process returns to the main routine, which is not shown in the drawing (Step S7: Y).

The present invention may be embodied with such an arrangement also, and it is effective especially with a PDP like the one driven in the third embodiment, in which the electrodes are disposed in a different order in some areas.

Figure 12:
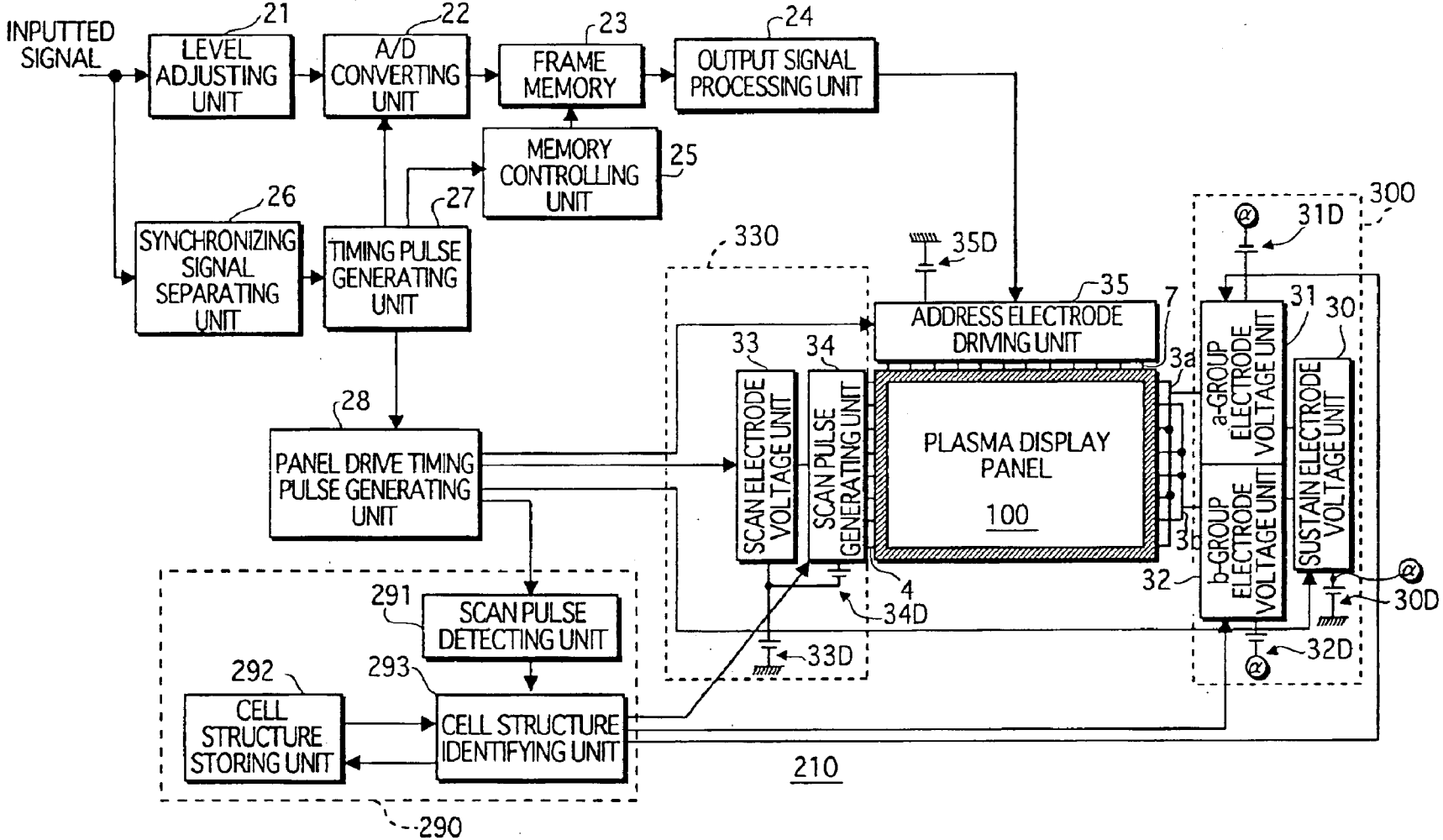
FIG. 12 is a block diagram for a PDP driving apparatus in a modification.

(2) In the modification example (1), a timing pulse is transmitted from the panel drive timing pulse generating unit 28 to the scan pulse generating unit 34; however, in the modification example (2), it is arranged so that a timing pulse is transmitted from the cell structure identifying unit 293 as shown in FIG. 12. Such an arrangement is suitable when the driving method discussed in the second embodiment is used. That is to say, it is possible to selectively apply a scan pulse to the scan electrodes 4 in the odd number lines or the even number lines, according to the timing pulse transmitted from the cell structure identifying unit 293, and thus, it is possible to reduce the number of times for the electric potential of the sustain electrodes to be changed during an address period like in the second embodiment. This way, a PDP driving method with capability of lowering power consumption can be actualized.

Figure 13:
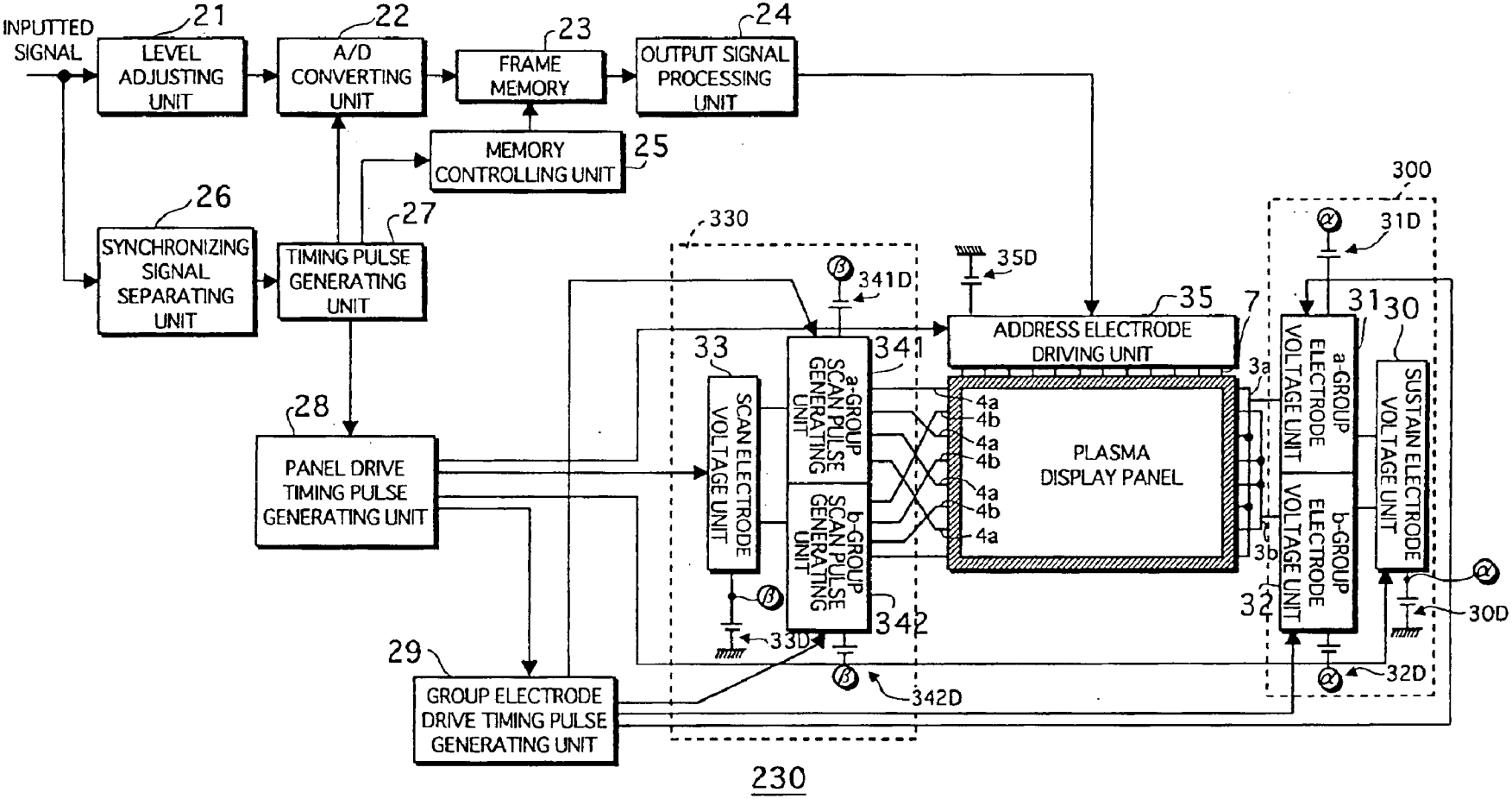
FIG. 13 is a block diagram for a PDP driving apparatus in a modification.

(3) A PDP driving apparatus shown in FIG. 13 is also suitable for the driving method discussed in the second embodiment.

In the PDP driving apparatus 230 shown in the drawing, the a-group scan pulse generating unit 341 and the b-group scan pulse generating unit 342 are provided, instead of the scan pulse generating unit 34 in FIG. 3.

The a-group scan pulse generating unit 341 is connected to the a-group scan electrodes 4*a* which form cells in combination with the a-group sustain electrodes 3*a,* and applies the scan pulse Pscn to each of the a-group scan electrodes 4*a* one by one starting from the upper side, according to the timing pulse transmitted from the group electrode drive timing pulse generating unit 29.

The b-group scan pulse generating unit 342 is connected to the b-group scan electrodes 4*b* which form cells in combination with the b-group sustain electrodes 3*b,* and applies the scan pulse Pscn to each of the b-group scan electrodes 4*b* one by one starting from the upper side, according to the timing pulse transmitted from the group electrode drive timing pulse generating unit 29, just like the a-group scan pulse generating unit 341.

It is possible to actualize the driving method discussed in the second embodiment with such an arrangement.

(4) In the second embodiment, for all the cells in the PDP, any two cells whose sustain electrodes 3 are positioned adjacent to each other are divided into two different cell groups in which the scan electrodes 4 and the sustain electrodes 3 are disposed in different orders, such as the cell group that includes the a-group sustain electrodes and the cell group that includes the b-group sustain electrodes. Address discharges are sequentially performed within each of the two different cell groups; however, other ways of organizing cell groups are also acceptable as long as the two adjacent cells are separated, for example, it is possible to organize cell groups so that both a-group sustain electrodes 3*a* and b-group sustain electrodes 3*b* exist together in a cell group. Even in such a case, in any two cells whose sustain electrodes are positioned adjacent to each other, the voltage applied to the sustain electrode 3 of the cell not having an address discharge is maintained low, it is therefore possible to inhibit occurrence of improper address discharges. This is possible by electrically connecting the sustain electrodes in the PDP within each of the groups to which they each belong. Such a driving method and the corresponding driving apparatus are also applicable to the third embodiment.

(5) In the embodiment discussed above, the a- and the b-group sustain electrodes 3*a* and 3*b* are electrically connected within the panel, but the invention is not limited to this, and is applicable even if the group sustain electrodes 3*a* and 3*b* are connected outside the panel.

Effects of the Invention

As so far explained, the PDP driving method of the present invention is a driving method for a PDP in which a sustain electrode of a cell and another sustain electrode of the adjacent cell are positioned adjacent to each other. At times of address discharges when voltages are applied to the scan electrodes and the address electrodes, it is arranged so that there is a potential difference between (a) a voltage to be applied to the sustain electrode of a cell having an address discharge and (b) a voltage to be applied to the sustain electrode which is positioned adjacent to that sustain electrode and is of the adjacent cell; therefore, it is possible, for example, to arrange so that the potential difference between the scan electrode and the sustain electrode of a cell having an address discharge is higher than the potential difference between another sustain electrode positioned adjacent to that sustain electrode and the same scan electrode. Thus, it is possible to inhibit occurrence of improper address discharges due to error discharges.

Further, the PDP driving apparatus of the present invention is a driving apparatus for a PDP in which a sustain electrode of a cell and another sustain electrode of the adjacent cell are positioned adjacent to each other. The sustain electrode driving unit includes (i) a first electrode voltage unit (e.g. a-group electrode voltage unit) operable to apply a voltage to sustain electrodes belonging to a first group (e.g. a-group) and (ii) a second electrode voltage unit (e.g. b-group electrode voltage unit) operable to apply to sustain electrodes belonging to a second group (e.g. b-group) another voltage having a potential difference from the voltage applied by the first electrode voltage unit, wherein a sustain electrode belonging to the first group and another sustain electrode belonging to the second group are positioned adjacent to each other. The driving apparatus further comprises an electrode drive timing pulse generating unit operable to adjust the drive timings of the first electrode voltage unit and the second electrode voltage unit. Thus, it is possible to arrange so that the potential difference between the scan electrode and the sustain electrode of a cell having an address discharge is higher than the potential difference between another sustain electrode positioned adjacent to that sustain electrode and the same scan electrode. Accordingly, it is possible to inhibit occurrence of improper address discharges due to error discharges.

INDUSTRIAL APPLICABILITY

The PDP driving method and apparatus of the present invention are effective especially for plasma display panels with fine display quality.

What is claimed is:

1. A driving method for a plasma display panel that includes pairs of display electrodes made up of a first row electrode and a second row electrode disposed in stripes and column electrodes, the display electrodes being disposed so as to intersect the column electrodes with a discharge space interposed therebetween so that a cell is formed at each of intersections, and in at least one of the pairs of display electrodes, the first row electrode and the second row electrode are disposed in a reversed order compared to the other pairs of display electrodes, wherein a potential difference is made at a time of generating an address discharge, that is when a voltage is applied to a combination of the first row electrode and the column electrode, the potential difference being a difference between (a) a voltage applied to a particular second row electrode of a cell having the address discharge and (b) a voltage applied to another second row electrode that is positioned adjacent to the particular second row electrode and is of a cell positioned adjacent to the cell having the address discharge.

2. The driving method of claim 1, wherein the voltage applied to the second row electrode of the cell having the address discharge is higher than the voltage applied to the other second row electrode positioned adjacent to that second row electrode.

3. The driving method of claim 1, wherein in every part of the plasma display panel, any two cells whose second row electrodes are positioned adjacent to each other belong to two different cell groups, and the address discharges are generated sequentially within each of the two different cell groups.

4. A driving apparatus for a plasma display panel that includes pairs of display electrodes made up of a first row electrode and a second row electrode disposed in stripes and column electrodes, the display electrodes being disposed so as to intersect the column electrodes with a discharge space interposed therebetween so that a cell is formed at each of intersections, and in at least one of the pairs of display electrodes, the first row electrode and the second row electrode are disposed in a reversed order compared to the other pairs of display electrodes, the driving apparatus comprising:

a first row electrode driving unit operable to apply a voltage to each of the first row electrodes;

a second row electrode driving unit operable to apply a voltage to each of the second row electrodes; and a column electrode driving unit operable to apply a voltage to each of the column electrodes, wherein the first row electrode driving unit and the column electrode driving unit generate an address discharge in a selected cell by applying a voltage to a first row electrode and a column electrode of the selected cell respectively, the first row electrode driving unit and the second row electrode driving unit generate a sustain discharge in the selected cell by applying a voltage to the first row electrode and a second row electrode of the selected cell respectively after the address discharge being generated, the second row electrode driving unit includes (a) a first voltage subunit operable to apply a first voltage to each of the second row electrodes of cells belonging to a first cell group, and (b) a second voltage subunit operable to apply a second voltage, which has a potential difference from the first voltage, to each of the second row electrodes of cells belonging to a second cell group, each of the second row electrodes in the first cell group being positioned adjacent to each of the second row electrodes in the second cell group, and the driving apparatus further comprises a timing pulse generating unit operable to adjust drive timings of the first voltage subunit and the second voltage subunit.

5. The driving apparatus of claim 4, wherein all the cells in the plasma display panel belong to either the first cell group or the second cell group, and the timing pulse generating unit includes:

a cell structure storing subunit operable to store therein information on locations of the second row electrodes belonging to the first cell group and the second row electrodes belonging to the second cell group;

a detecting subunit operable to detect a location of a cell having an address discharge; and a cell structure identifying subunit operable to identify, by referring to the information stored in the cell structure storing subunit corresponding to the location of the cell detected by the detecting subunit, to which of the first and the second cell groups the second row electrode of the cell having the address discharge belongs and adjust the drive timings.

6. The driving apparatus of claim 4, wherein all the cells in the plasma display panel belong to either the first cell group or the second cell group, and the first row electrode driving unit applies the voltages so that the address discharges are generated sequentially within each of the first and the second cell groups.

7. The driving apparatus of claim 6, wherein the first row electrode driving unit includes:

a first voltage subunit operable to apply a scan pulse to each of the first row electrodes belonging to the first cell group; and a second voltage subunit operable to apply a scan pulse to each of the first row electrodes belonging to the second cell group.

8. The driving apparatus of claim 4, wherein a phase of the first voltage applied by the first voltage subunit and a phase of the second voltage applied by the second voltage subunit are staggered from each other by half a cycle.

* * * * *